US009650578B2

(12) United States Patent
De Klerk et al.

(10) Patent No.: US 9,650,578 B2
(45) Date of Patent: May 16, 2017

(54) INTEGRATED CENTRAL PROCESSING FACILITY (CPF) IN OIL FIELD UPGRADING (OFU)

(71) Applicant: Nexen Energy ULC, Calgary, Alberta (CA)

(72) Inventors: Amo De Klerk, Edmonton (CA); Nestor Gregorio Zerpa Reques, Calgary (CA); Yuhan Xia, Calgary (CA); Ayyub Abduljawad Omer, Calgary (CA)

(73) Assignee: NEXEN ENERGY ULC, Calgary, Alberta (CA)

( * ) Notice: Subject to any disclaimer, the term of this patent is extended or adjusted under 35 U.S.C. 154(b) by 500 days.

(21) Appl. No.: 14/134,595

(22) Filed: Dec. 19, 2013

(65) Prior Publication Data

US 2014/0138287 A1 May 22, 2014

Related U.S. Application Data

(63) Continuation-in-part of application No. 13/535,983, filed on Jun. 28, 2012.

(Continued)

(51) Int. Cl.

*C10G 55/06* (2006.01)
*C10G 55/04* (2006.01)

(Continued)

(52) U.S. Cl.

CPC ..... *C10G 55/06* (2013.01); *C10G 9/36* (2013.01); *C10G 21/003* (2013.01); *C10G 55/04* (2013.01);

(Continued)

(58) Field of Classification Search

CPC ..... C10G 55/06; C10G 21/003; C10G 55/04; C10G 9/36; C10G 2300/308;

(Continued)

(56) References Cited

U.S. PATENT DOCUMENTS 4,795,550 A 1/1989 Sachtler et al.
5,192,421 A * 3/1993 Audeh ..... C10G 21/003 208/309

(Continued)

FOREIGN PATENT DOCUMENTS

CA 2192524 A1 6/1997
CN 101910366 A 12/2010

(Continued)

OTHER PUBLICATIONS

WIPO, International Preliminary Report on Patentability for International Application No. PCT/CA2013/001066 dated Jun. 5, 2015.

(Continued)

*Primary Examiner* — Randy Boyer
*Assistant Examiner* — Juan Valencia
(74) *Attorney, Agent, or Firm* — Norton Rose Fulbright Canada LLP

(57) ABSTRACT

A process for upgrading oil including optionally pre-treating a heavy oil including at least one dissolved gas, asphaltenes, water, and mineral solids; reducing at least one dissolved gas content from said heavy oil, optionally further reducing water content from said heavy oil; adding a paraffinic solvent to said heavy oil, at a predetermined paraffinic solvent:heavy oil ratio, facilitating separation of asphaltenes, water, and mineral solids from the heavy oil resulting in a de-asphalted or partially de-asphalted oil ("DAO")-paraffinic solvent stream, comprising a low asphaltenes content DAO-paraffinic solvent stream and an asphaltenes-mineral solids-paraffinic solvent-water slurry (Continued)

stream; optionally separating the paraffinic solvent and water from the asphaltenes-mineral solids-paraffinic solvent-water slurry stream; optionally separating the DAO-paraffinic solvent stream into a paraffinic solvent rich stream and a DAO stream; and optionally adding diluent to the DAO stream resulting in transportable oil.

54 Claims, 7 Drawing Sheets

Related U.S. Application Data

(60) Provisional application No. 61/745,258, filed on Dec. 21, 2012, provisional application No. 61/843,002, filed on Jul. 4, 2013, provisional application No. 61/503,277, filed on Jun. 30, 2011.

(51) Int. Cl.
*C10L 1/08* (2006.01)
*C10G 9/36* (2006.01)
*C10G 21/00* (2006.01)

(52) U.S. Cl.
CPC ..... *C10L 1/08* (2013.01); *C10G 2300/1059* (2013.01); *C10G 2300/1077* (2013.01); *C10G 2300/206* (2013.01); *C10G 2300/301* (2013.01); *C10G 2300/302* (2013.01); *C10G 2300/308* (2013.01)

(58) Field of Classification Search
CPC ..... C10G 2300/206; C10G 2300/1059; C10G 2300/302; C10G 2300/301; C10G 2300/1077; C10L 1/08
See application file for complete search history.

(56) References Cited

U.S. PATENT DOCUMENTS

| | | | | |
|---|---|---|---|---|
| 5,290,428 | A | 3/1994 | Strausz et al. | |
| 5,944,984 | A * | 8/1999 | Benguigui | C10G 21/003 196/14.52 |
| 8,449,764 | B2 * | 5/2013 | Chakrabarty | C10G 1/045 208/311 |
| 2006/0118463 | A1 * | 6/2006 | Colyar | C10G 67/00 208/86 |
| 2006/0283776 | A1 * | 12/2006 | Iqbal | C10G 21/003 208/86 |
| 2009/0166254 | A1 | 7/2009 | Subramanian et al. | |
| 2009/0200209 | A1 * | 8/2009 | Sury | C10G 1/045 208/390 |
| 2013/0240407 | A1 * | 9/2013 | Gillis | C10G 55/04 208/86 |

FOREIGN PATENT DOCUMENTS

| | | | |
|---|---|---|---|
| CN | 101952395 | A | 1/2011 |
| CN | 101203586 | B | 10/2012 |

OTHER PUBLICATIONS

WIPO, International Search Report and Written Opinion for International Application No. PCT/CA2013/001066 dated Mar. 28, 2016.
WIPO, International Preliminary Report on Patentability for International Application No. PCT/CA2014/000541 dated Jan. 5, 2016.
WIPO, International Search Report and Written Opinion for International Application No. PCT/CA2014/000541 dated Sep. 17, 2014.
WIPO, International Search Report and Written Opinion for International Application No. PCTCA2014000915 Mar. 26, 2015.
The Colombian Trademark and Patent Office, Office Action No. 9575 for corresponding CO Application No. 15-168175 dated Aug. 11, 2015, and English translation thereof.

* cited by examiner

INTEGRATED CENTRAL PROCESSING FACILITY (CPF) IN OIL FIELD UPGRADING (OFU)

FIELD OF THE INVENTION

The present invention relates to improved heavy oil and/or bitumen recovery and upgrading processes and systems resulting in upgraded oil.

BACKGROUND OF THE INVENTION

It is well known that heavy oil and/or bitumen are difficult to transport from their production areas due to their high viscosities at typical handling temperatures. On the other hand, light oils generally have much lower viscosity values and therefore flow more easily through pipelines. Regardless of the recovery method used for their extraction, heavy oil and/or bitumen generally need to be diluted by blending the heavy oil and/or bitumen with at least one low density and low viscosity diluent to make the heavy oil and/or bitumen transportable, in particular over long distances. The diluents used are typically gas condensate, naphtha, lighter oil, or a combination of any of the three. For example in Canada, when making transportable oil and using gas condensate as a diluent, the volume of gas condensate added to the bitumen is typically 30 to 35% of the total product.

There are several disadvantages of adding diluent to heavy oil and/or bitumen to produce transportable oil including:

- Well remoteness makes the construction of pipelines for sending or returning the diluents to the heavy hydrocarbon production zone considerably expensive; and
- Availability of diluents, typically light hydrocarbons, such as gas condensates, is steadily decreasing worldwide, making them more expensive to procure.

Chemical processing has become an attractive alternative for converting heavy oil and/or bitumen into transportable oil, and in some cases chemical processing is the only viable alternative for transporting heavy oil and/or bitumen to refineries and market places.

Most chemical processes for converting heavy oil and/or bitumen into transportable oil are thermal cracking based systems. Thermal cracking based systems range from moderate thermal cracking such as visbreaking to more severe thermal cracking such as coking systems. These processes are generally applied to the heaviest hydrocarbons in the heavy oil and/or bitumen, typically the fraction called the vacuum residue ("VR") which contains a high concentration of asphaltenes.

One disadvantage of the above chemical processes is the limited conversion of heavy hydrocarbons into lighter hydrocarbons due to the generation and instability of asphaltenes during these processes. These processes reduce the stability of the heavy oil due to the disruption of the asphaltenes-resins interactions. This instability increases with increased conversion levels, resulting in the precipitation of asphaltenes and the formation of problematic deposits in equipment and pipes.

In coking systems, asphaltenes are converted into coke which requires the addition of complex and expensive equipment to deal with the coke.

Another disadvantage of the above chemical processes is the production of cracked material by-products (e.g. olefins and di-olefins). If left untreated, olefins and di-olefins may react with oxygen (such as oxygen in the air) or other reactive compounds (e.g. organic acids, carbonyls, amines, etc.) to form long chain polymers, commonly referred to as gums, which further foul downstream process equipment. To reduce the olefins and di-olefins in the final product, expensive hydro-processing and hydrogen generation infrastructures must be used to treat the cracked material.

The disadvantages described above translate into significant cost and complexity, rendering small scale applications of these technologies uneconomical. In Long Lake, Alberta, Canada, Steam Assisted Gravity Drainage ("SAGD") technology is used to recover bitumen. The bitumen is mixed with a light hydrocarbon as a diluent, which dilutes the thick bitumen and enables it to flow ("DilBit"). The DilBit is then upgraded into premium crude oil at the onsite upgrader using a paraffinic solvent de-asphalting ("SDA") unit, followed by thermal cracking and hydrocracking technologies. The bitumen is upgraded into 40 API synthetic oil and the rejected asphaltenes are fed into a gasifier to generate the hydrogen for hydrocracking as well as the energy required to extract the bitumen from the reservoir. Such complexity is typical of current technological state-of-the-art processes in bitumen recovery and treatment.

Several patents have been published which discuss attempts to address these problems (U.S. Pat. No. 7,981,277, U.S. Pat. No. 4,443,328, US2009/0200209, CA2232929, CA2217300, and CA2773000). Each of these references, however, suffer from one or more of the following disadvantages:

- The simultaneous removal of water and asphaltenes is not contemplated, resulting in the asphaltenes causing equipment plugging issues as discussed above;
- There is no water in the asphaltenes feed so more valuable lighter hydrocarbons must be precipitated with the asphaltenes to act as a viscosity-reducing diluent. This substantially reduces recovery which lowers profit;
- Only applicable to mine applications;
- Overcracking of the bitumen in the upright cylindrical reactor (U.S. Pat. No. 4,443,328) is not addressed; and
- Production of olefins and di-olefins in the thermally cracked material is not addressed.

There is a need for improved heavy oil and/or bitumen recovery and upgrading processes.

SUMMARY OF THE INVENTION

The term "heavy oil" as used herein comprises hydrocarbons that are highly viscous and do not flow easily. In one instance, heavy oil has been defined as having an average API gravity of 20° or lower. In some instances, depending on reservoir conditions, said heavy oil further comprises at least one dissolved gas, asphaltenes, water, and mineral solids. In another instance, depending on production methods, said heavy oil further comprises at least one solvent and/or any other production additive or the like. "Bitumen" is a subset of heavy oil and typically is characterized by having an API gravity of 12° or lower. In its natural state, such as in Canada's Oil Sands or Venezuela's Orinoco Oil Belt, bitumen generally includes fine solids such as mineral solids and C5-insoluble asphaltenes in the range of 10 to 18% w/w.

The term "asphaltenes" as used herein refers to the heaviest and most polar molecules component of a carbonaceous material such as crude oil, bitumen or coal and are defined as a solubility class of materials that are insoluble in an n-alkane (usually n-pentane or n-heptane) but soluble in aromatic solvents such as toluene. In crude oil, asphaltenes are found, along with saturated and aromatic hydrocarbons and resins ("SARA"). Asphaltenes consist primarily of carbon, hydrogen, nitrogen, oxygen, and sulfur, as well as trace amounts of vanadium and nickel. The density is approximately 1.2 g/cc and the hydrogen to carbon atomic ratio is approximately 1.2, depending on the asphaltenes source and the solvent used for extraction. The asphaltenes fraction is also responsible for a large percentage of the contaminants contained in the bitumen (for example Athabasca bitumen is typically 72%-76% w/w of the metals, 53%-58% w/w of coke precursors, and 26%-31% w/w of the heteroatoms—sulphur, nitrogen and oxygen), making bitumen very challenging to process into clean and valuable products.

The term "mineral solids" as used herein refers to non-volatile, non-hydrocarbon solid minerals. Depending on the hydrocarbon reservoir, these mineral solids may have a density of from 2.0 g/cc to about 3.0 g/cc and may comprise silicon, aluminum (e.g. silicas and clays), iron, sulfur, and titanium and range in size from less than 1 micron to about 1,000 microns in diameter.

The term "paraffinic solvent" (also known as alkane or aliphatic solvent) as used herein means a solvent containing normal paraffins, isoparaffins and blends thereof in the C3 to C20 carbon range, preferably in the C4 to C8 carbon range and most preferably in the C5 to C7 carbon range. These paraffinic solvents may be produced from the processing of gas streams commonly referred to as natural gas condensates or from refinery hydrocarbon streams commonly referred to as naphthas. The presence of non-paraffinic hydrocarbons in said paraffinic solvent, such as aromatics, olefins and naphthenes (as well as other undesirable compounds, such as but not limited to heteroatom containing molecules), counteract the function of the paraffinic solvent and hence should preferably be limited to less than 20% w/w, preferably less than 10% w/w and most preferably to less than 5% w/w of the total paraffinic solvent content. In one embodiment, the paraffinic solvent comprises a natural gas condensate, preferably having about 1.8% w/w n-butane, 25.1% w/w n-pentane, 27.7% w/w iso-pentane, 22.3% w/w n-hexane, 13.7% w/w n-heptane, 5.4% w/w n-octane and 4% w/w of the counteracting components mentioned previously. In another embodiment, the paraffinic solvent comprises 1.4% w/w n-butane, 96.8% w/w n-pentane, 1.5% w/w iso-pentane and 0.3% w/w of the counteracting components mentioned previously. In another embodiment, the paraffinic solvent comprises 95% w/w n-hexane, 3.3% w/w iso-hexane and 1.7% w/w of the counteracting components previously mentioned. In yet another embodiment, the paraffinic solvent comprises 99% w/w n-heptane, 0.1% w/w iso-octane and 0.9% w/w of the counteracting components previously mentioned. Preferably the paraffinic solvent choice is dictated by preferred economics.

The terms "upgraded oil" or "transportable oil" as used herein are used interchangeably and refer to a hydrocarbon oil having the collection of product quality specifications such that the oil meets at least one pipeline and/or operating specification, preferably such that the oil must meet in order for it to be shipped through a pipeline (including but not limited to common carrier, private, gathering, and facility pipelines). These specifications differ from region to region and from operator to operator, taking into account location as well as climate/seasonal conditions and the final user requirements. For example, in Canada, one common carrier pipeline requires the transportable or upgraded oil to have a temperature not greater than 38° C., a Reid vapour pressure not greater than 103 kilopascals, a sediment and water content not greater than 0.5% v, a density not greater than 940 kilograms per cubic meter at 15° C., a kinematic viscosity not greater than 350 square millimeters per second determined at the carrier's reference line temperature and olefins content as determined by an HNMR test, not greater than 1.0% olefins by mass as 1-decene equivalent.

The term "water droplet" as used herein refers to a volume of water, preferably a small volume of water having a predetermined shape, preferably an approximately spherical shape. Water droplets are introduced into the continuous heavy hydrocarbon+paraffinic solvent phase facilitating agglomeration of destabilized asphaltenes particles increasing floc size, preferably by charge site binding and by molecular bridging. In one instance, the addition of water droplets into the system of the present invention increases the settling rate of the destabilized asphaltenes and decreases the size and cost of the separator equipment used. Preferably the addition of water droplets in the process is such that entrainment is reduced, preferably minimized, more preferably avoided. In one embodiment, water droplets are introduced proximate the heavy oil and paraffinic solvent mixture inlet of the separator and distant the de-asphalted oil ("DAO")—paraffinic solvent outlet of the separator, reducing entrainment in the DAO—paraffinic solvent stream.

The preferred average water droplet diameter varies based on the characteristics of the specific system; preferably said average diameter is in the range of from about 5 to about 500 microns, more preferably from about 50 to about 150 microns.

Preferably, the amount and specification of water droplets added to the heavy hydrocarbon+paraffinic solvent phase is such that it facilitates agglomeration of destabilized asphaltenes particles, resulting in increased floc size. More preferably the amount of water droplets may be from about 0.5 to about 1.5 vol/vol of the C5-Insolubles being rejected from the original heavy hydrocarbon or bitumen. The amount and temperature of the water droplets added to the phase may be adjusted depending on the feed and process characteristics (e.g. temperature, density and viscosity of the continuous heavy hydrocarbon+paraffinic solvent phase, water droplet size distribution, location of the water droplets injection point relative to the continuous phase level, mixing energy, water quality, etc.).

A further benefit of the addition of water droplets into the continuous heavy hydrocarbon+paraffinic solvent phase is an increased collision between water droplets due to the increased population of water droplets in the heavy hydrocarbon+paraffinic solvent continuous phase, facilitating the coalescence and removal of contaminants in the oil, in one embodiment, the coalescence and removal of higher salinity water originally present in the oil.

The water used for water droplets to be added to the heavy hydrocarbon+paraffinic solvent phase, in the present invention, may be any source of water known to a person of ordinary skill in the art, which is not detrimental to the process as described herein. In one embodiment, the water droplet to be added to the phase, has the following specification:

| DESCRIPTION | WATER SPECIFICATION |
|---|---|
| pH @ 25° C. | 8.5-9.5 |
| Dissolved $O_2$, wt. ppb | 5 max. |
| Total Hardness as $CaCO_3$, wt. ppm | 0.2 max. |
| Calcium as $CaCO_3$, wt. ppm | 0.1 max. |
| Sodium as $CaCO_3$, wt. ppm | 0.5 max. |
| Sulfates as $CaCO_3$, wt. ppm | 0.1 max. |
| Total Alkalinity as $CaCO_3$, wt. ppm | Nil |
| Silica as $SiO_2$, wt. ppm | 0.1 max. |
| Chlorides as Chlorine, wt. ppm | 1 max. |

-continued

| DESCRIPTION | WATER SPECIFICATION |
|---|---|
| Total Dissolved Solids, wt. ppm | 10 max. |
| Conductivity @ 25° C., μMHOS/cm | 15 max. |

Droplets may be formed using spray nozzles or any other method of producing droplets known to a person of ordinary skill in the art.

According to one aspect, the present invention is directed to a system for recovery and upgrading of heavy oil to a transportable oil, said system comprises combining oil-water-mineral solids separation, solvent de-asphalting and fractionation, and optionally, thermal cracking and olefin conversion, preferably in an integrated processing unit, more preferably in a single integrated processing unit.

In one embodiment, said system increases the value of hydrocarbon recovery and upgrading heavy oil and/or bitumen, by combining oil-water-mineral solids separation, solvent de-asphalting and fractionation, and optionally, thermal cracking and olefin conversion, such that small scale field upgrading becomes economically viable.

The present invention is also directed to at least one process, preferably a plurality of processes to produce upgraded oil which meets at least one pipeline and/or operating specification.

Further, this invention is particularly suited to heavy oil generated from oil sands which contain bitumen, gas, asphaltenes, water, and mineral solids. These heavy oil production methods include, but are not limited to, Steam Assisted Gravity Drainage ("SAGD"), Cyclic Steam Stimulation ("CSS"), mining, pure solvent extraction based or steam-solvent combinations (e.g. vapour extraction process ("Vapex"), N-Solv™, expanding solvent steam assisted gravity drainage ("ES-SAGD"), enhanced solvent extraction incorporating electromagnetic heating ("ESEIEH")), or any other oil recovery technology known to a person of ordinary skill in the art.

Further, this invention is applicable to heavy oil production methods including offshore oil production and the like.

According to one embodiment of the invention, there is provided at least one process for upgrading oil comprising: a) optionally pre-treating a heavy oil (comprising at least one dissolved gas, asphaltenes, water, and mineral solids), to remove at least one dissolved gas and optionally a predetermined amount of water from the heavy oil, b) adding a paraffinic solvent to the heavy oil, at a predetermined paraffinic solvent:heavy oil ratio, facilitating separation of asphaltenes, water, and mineral solids from the heavy oil resulting in a de-asphalted or partially de-asphalted oil ("DAO")-paraffinic solvent stream, preferably a low asphaltenes content DAO-paraffinic solvent stream and an asphaltenes-mineral solids-paraffinic solvent-water slurry stream, optionally a water feed is introduced for the generation of water droplets to further facilitate separation of asphaltenes, water, and mineral solids from the heavy oil; c) optionally separating the paraffinic solvent and water from the asphaltenes-mineral solids-paraffinic solvent-water slurry stream, preferably said paraffinic solvent may be used in said process; d) optionally separating the DAO— paraffinic solvent stream into a paraffinic solvent rich stream and a DAO stream; and e) optionally adding diluent to the DAO stream resulting in transportable oil, in one embodiment said diluent being selected from the paraffinic solvent used in step (b) or any other diluent known to an ordinary person skilled in the art, and combinations thereof.

In one embodiment, step (d) further comprises at least one fractionating step, preferably at least one supercritical paraffinic solvent recovery step followed by at least one fractionating step.

According to yet another embodiment of the invention, subsequent to step (c), said process further comprises (f) fractionating said DAO-paraffinic solvent stream resulting in a paraffinic solvent rich stream, at least one distillate hydrocarbon fraction stream, preferably at least two distillate hydrocarbon fraction streams, and at least one heavy residue fraction stream; said process further comprises: cracking a portion of said at least one heavy residue fraction stream, preferably in a thermal cracker or a catalytic cracker, and in one embodiment a catalytic steam cracker, comprising a heater, optionally said thermal cracker or catalytic steam cracker further comprises a soaker, said thermal cracker or said catalytic steam cracker forming at least one cracked stream, wherein said at least one cracked stream is mixed with said DAO-paraffinic solvent stream to be fractionated; in one embodiment, said soaker comprises a conventional up-flow soaker; in another embodiment, said soaker comprises a high efficiency soaker; (g) treating said at least one distillate hydrocarbon fraction, for reduction of olefins and di-olefins, and optionally heteroatom reduction, wherein said treating comprises hydrotreatment or olefins-aromatics alkylation, and combinations thereof, resulting in at least one treated distillate hydrocarbon fraction stream; h) mixing said at least one treated distillate hydrocarbon fraction stream with the uncracked portion of said at least one heavy residue fraction stream forming an upgraded oil; optionally when there are at least two distillate hydrocarbon fraction streams wherein at least one distillate hydrocarbon fraction stream is untreated, said at least one untreated distillate hydrocarbon fraction stream is further added to said upgraded oil.

In one embodiment, when said soaker is a high efficiency soaker, said at least one heavy residue fraction stream is cracked into a light cracked stream and a heavy cracked stream. Wherein said heavy cracked stream is recycled to step (b) and said light cracked stream is mixed with said DAO-paraffinic solvent stream.

In one embodiment, said process further comprises at least one fractionating step, preferably at least one supercritical paraffinic solvent recovery step followed by at least one fractionating step.

According to another embodiment of the invention, said a) optionally treating a heavy oil (comprising at least one dissolved gas, asphaltenes, water, and mineral solids), to reduce at least one dissolved gas and optionally a predetermined amount of water from the heavy oil, comprises introducing said heavy oil to a gravity separator, a centrifuge and/or separating means understood by those skilled in the art.

According to a yet another embodiment of the invention, there is provided a process for upgrading heavy oil wherein when using a catalytic steam cracker, adding at least one catalyst to said heavy residue fraction stream to be cracked. In one embodiment said at least one catalyst is a nano-catalyst. In yet another embodiment said nano-catalyst has a particle size of from about 20 to about 120 nanometers, preferably said nano-catalyst is comprised of a metal selected from rare earth oxides, group IV metals, and mixtures thereof in combination with NiO, CoOx, alkali metals and $MoO_3$.

In a preferred embodiment, in step (b), the presence of water within the heavy oil is advantageous, as the water forms a slurry with the rejected asphaltenes, reducing hydraulic limitations in the handling of asphaltenes and allowing for higher recovery of DAO in the present process.

Preferably in any of the above embodiments, the paraffinic solvent:heavy oil ratio is from about 0.6 to about 10.0 w/w, more preferably from about 1.0 to about 6.0 w/w.

Preferably separation of asphaltenes, water, and mineral solids from the heavy oil resulting in a de-asphalted or partially de-asphalted oil ("DAO")-paraffinic solvent stream and an asphaltenes-mineral solids-paraffinic solvent-water slurry stream is carried out at a temperature from about ambient temperature to about critical temperature of said paraffinic solvent. More preferably at a temperature from about 35° C. to about 267° C., most preferably from about 60° C. to about 200° C. Preferably said separation is carried out at a pressure of from about the paraffinic solvent vapour pressure to higher than the paraffinic solvent critical pressure, more preferably from about 10% higher than the paraffinic solvent vapour pressure to about 20% higher than the paraffinic solvent critical pressure. Preferably said separation is carried out in at least one solvent de-asphalting ("SDA") unit.

Preferably in any of the above embodiments, said separation removes at least a minimum amount of asphaltenes resulting in a transportable oil according to the present invention.

Preferably in any of the above embodiments, when a cracking step is involved, said separation removes at least a minimum amount of asphaltenes allowing cracking to proceed by reducing the formation of problematic deposits in equipment and pipes, according to the present invention.

Preferably in any of the above embodiments, when a catalytic cracking step is involved, said separation removes at least a minimum amount of asphaltenes allowing catalytic cracking to proceed.

In one embodiment, when a catalytic cracking step is involved, said catalytic cracking is catalytic steam cracking In one embodiment, at least about 30% of n-C5 insoluble asphaltenes are removed to reduce any negative impact on the catalysts used in catalytic steam cracking. Preferably said cracking step, comprises a heater and an optional conventional soaker or a high efficiency soaker ("HES"), wherein said cracking step is carried out at a temperature range of from about 300° C. to about 480° C., more preferably from about 400° C. to about 465° C. Preferably said cracking step is carried out at a pressure range of from about atmospheric pressure to about 4500 kPa, more preferably from about 1000 kPa to about 4000 kPa. Preferably said cracking step has a liquid hourly space velocity ("LHSV") of from about 0.1 $h^{-1}$ to about 10 $h^{-1}$, more preferably from about 0.5 $h^{-1}$ to about 5 $h^{-1}$. Preferably said cracking step is carried out in at least one thermal cracking unit or at least one catalytic steam cracking unit.

In any of the above embodiments, said process further comprises at least one mixing step, wherein said at least one mixing step is selected from those known to a person of ordinary skill in the art. In yet a further preferred embodiment, said at least one mixing step comprises sonic-mixing.

In one embodiment, the high efficiency soaker (HES) is a soaking drum, where sufficient residence time is provided to crack a heated heavy residue fraction stream (feed) to a desired conversion while enhancing selectivity towards more valuable distillate products, and reduced asphaltenes content from the upgraded oil. After being processed through a feed heater the hot heavy residue fraction stream is introduced into the HES preferably via a distributor proximate the top section of the drum and the hot heavy residue fraction stream flows downward towards the lower section of the drum for further cracking. The HES reaction section preferably allows for plug-type flow. In one embodiment the HES reaction section comprises trays resulting in plug-type flow, preferably avoiding back-mixing and bypassing. These trays are preferably perforated sieve trays, but other type of trays known to a person of ordinary skill in the art, such as but not limited to, shed trays, random (e.g. Berl saddles or Raschig Rings) or structured packings, may also be used. The number of trays or the height of packing is a function of the desired conversion. As the reacting hot heavy residue fraction is exposed to increased residence time, the conversion to lighter hydrocarbon fractions also increases. Steam, preferably in the range of 0.01 to 0.10 w/w of feed, is introduced, preferably injected into the drum, preferably via a distributor proximate the bottom thereof, more preferably located below the bottom tray, flowing upward and counter-current to the reacting heavy residue fraction. To avoid quenching of the reaction and/or foaming inside the HES, the injected steam is preferably superheated to the same or higher temperature as the reacting hot heavy residue fraction. The injected steam further reduces the partial pressure of the hydrocarbons present, promoting disengagement, preferably fast disengagement of the lighter hydrocarbon fractions from the reacting hot heavy residue fraction, helping to recover these lighter hydrocarbon fractions from the bottom heavy cracked stream. Another advantage of the injected steam is the reduction of the residence time to which the lighter distillate fractions are exposed to cracking conditions.

When a catalyst is used, such as in a catalytic steam cracker, the steam also reacts to saturate olefins reducing olefins content in the top light cracked stream. The light hydrocarbons resulting from the reaction flow upward with the steam and exit at the top of the HES as a top light cracked stream, whereas the heavy unconverted hydrocarbons flow downwards resulting in a bottom heavy cracked stream and is sent for further treatment.

Preferably said at least one distillate hydrocarbon fraction is treated to reduce olefins and di-olefins and optionally heteroatoms, wherein said treatment comprises hydrotreatment or olefins-aromatics alkylation. Preferably, said olefins-aromatics alkylation further comprises contacting the feed material with at least one catalyst. Preferably, said olefins-aromatics alkylation is carried out at a temperature of from about 50° C. to about 350° C., more preferably from about 150° C. to about 320° C. Preferably said olefins-aromatics alkylation is carried out at a pressure of from about atmospheric pressure to about 8000 kPa, more preferably said pressure is from about 2000 kPa to about 5000 kPa, most preferably said pressure is about 10% higher than vapour pressure of the distillate hydrocarbon fraction to be treated. Preferably said olefins-aromatics alkylation is carried out at a weight hourly space velocity ("WHSV") of from about 0.1 $h^{-1}$ to about 20 $h^{-1}$, more preferably from about 0.5 $h^{-1}$ to about 2 $h^{-1}$.

Preferably, said at least one catalyst is an acid catalyst. Preferably said at least one acid catalyst is a heterogeneous catalyst. In one embodiment said heterogeneous catalyst is selected from the group consisting of amorphous silica-alumina, structured silica-alumina molecular sieves, MCM-41, crystalline silica-alumina zeolites, zeolites of the families MWW, BEA, MOR, MFI and FAU, solid phosphoric acid (SPA), aluminophosphase and silico-aluminophosphates, zeolites of the AEL family, heteropolyacids, acidic resins, acidified metals and mixtures thereof. The preference for a heterogeneous catalyst facilitates separation of the process liquid and catalyst. In accordance with the invention, said at least one acid catalyst should be selected so that it has sufficient acid strength to catalyze the olefins-aromatics alkylation reaction, as well as an acid strength distribution to retain sufficient activity in contact with a feed material that may contain basic compounds. Said at least one acid catalyst should further be selected so that the acid sites are accessible to large molecules, which is typical of the distillate hydrocarbon fraction. The operating temperature and catalyst acid strength distribution should be selected in combination to obtain the best compromise between the highest olefins-aromatics alkylation activity and least catalyst inhibition by compounds in the feed that are strongly adsorbing, or are basic in nature.

In yet another embodiment, the invention further comprises at least one supercritical paraffinic solvent recovery step. Preferably said step is carried out at a temperature higher than the critical temperature of said paraffinic solvent to be recovered; more preferably said step is carried out at a temperature from about 20° C. to about 50° C. above said paraffinic solvent critical temperature. Preferably said step is carried out at a pressure higher than the critical pressure of said paraffinic solvent to be recovered, more preferably from about 10% to about 20% higher than said paraffinic solvent critical pressure.

DETAILED DESCRIPTION OF THE PREFERRED EMBODIMENTS

Figure 1:
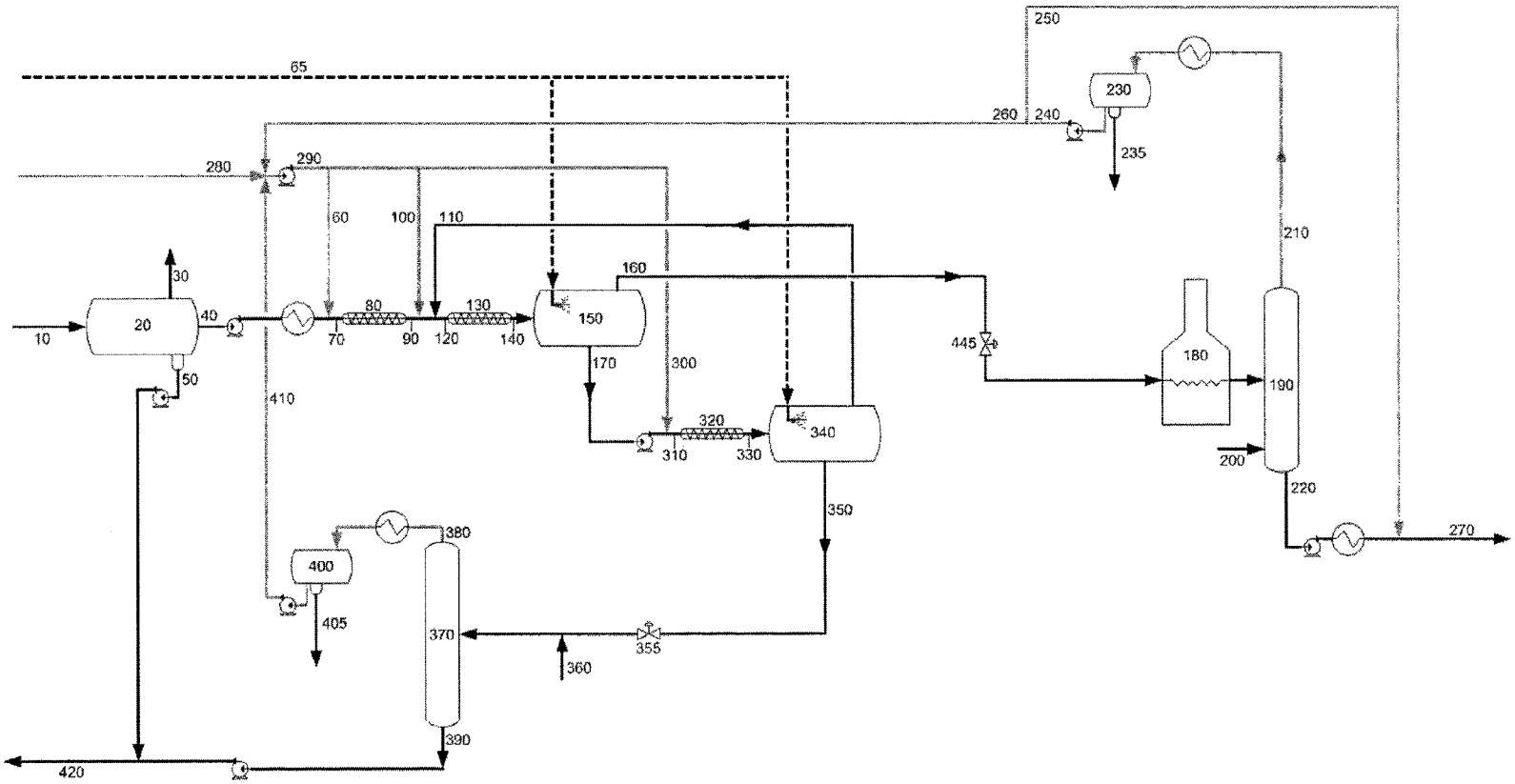
FIG. 1 depicts the present invention, in a preferred embodiment in a field upgrading facility.

Referring now to FIG. 1, a heavy oil feed stream further comprising gas, asphaltenes, water and mineral solids 10 is fed into a separator 20 separating the feed stream 10 into a gas stream 30, a heavy oil, asphaltenes, water and mineral solids stream 40 and a water stream 50. The gas stream 30 is sent for further treatment. The water stream 50 is sent to treatment. Heavy oil, asphaltenes, water and mineral solids stream 40 is mixed with a paraffinic solvent 60, forming a heavy oil, asphaltenes, water, mineral solids and paraffinic solvent stream 70 and introduced into a mixer 80. The outlet from mixer 80, a reduced viscosity stream 90, is combined with additional paraffinic solvent 100 and a recycle overflow stream 110 containing de-asphalted oil and paraffinic solvent from secondary separator 340, resulting in a heavy oil, asphaltenes, water, -mineral solids, paraffinic solvent and de-asphalted oil stream 120. Stream 120 is introduced into mixer 130 resulting in a mixed heavy oil, asphaltenes, water, mineral solids, paraffinic solvent and de-asphalted oil stream 140. Stream 140 is fed into a primary separator 150 producing an overflow de-asphalted oil and paraffinic solvent stream 160 and an underflow asphaltenes, water, mineral solids, residual heavy oil and residual paraffinic solvent stream 170. Optionally, primary separator 150 includes a localized heater (not shown) proximate the outlet of overflow de-asphalted oil and paraffinic solvent stream 160, creating a localized temperature increase resulting in a further asphaltenes reduced overflow de-asphalted oil and paraffinic solvent stream 160.

The overflow de-asphalted oil and paraffinic solvent stream 160, from primary separator 150, is depressurized via a control valve 445 and fed into a heater 180 and then fed into a fractionator 190. A steam stream 200 is also introduced into the fractionator 190. The fractionation results in a top paraffinic solvent, water stream 210 and a bottom de-asphalted oil stream 220. The top paraffinic solvent, water stream 210 is processed in a reflux drum 230 to produce a water stream 235 and a paraffinic solvent stream 240. Water stream 235 is sent for further treatment. Paraffinic solvent stream 240 is split into a paraffinic solvent stream 250 and a paraffinic solvent stream 260. The paraffinic solvent stream 250 is mixed with de-asphalted oil stream 220 resulting in an upgraded oil stream 270. Paraffinic solvent stream 260 is combined with make-up paraffinic solvent 280 and additional recovered paraffinic solvent 410 (resulting from fractionator 370) to form a paraffinic solvent stream 290.

Underflow asphaltenes, water, mineral solids, residual heavy oil and residual paraffinic solvent stream 170 is combined with paraffinic solvent stream 300, resulting in asphaltenes, water, mineral solids, residual heavy oil, residual paraffinic solvent and additional paraffinic solvent stream 310 which is introduced into a mixer 320 resulting in a mixed asphaltenes, water, mineral solids, residual heavy oil, residual paraffinic solvent and additional paraffinic solvent stream 330. Stream 330 is fed into a secondary separator 340 producing an overflow de-asphalted oil and paraffinic solvent stream 110 and an underflow asphaltenes, water, mineral solids, residual heavy oil and residual paraffinic solvent stream 350.

Underflow stream 350 is depressurized via control valve 355 and mixed with steam 360 and introduced into fractionator 370 producing a top paraffinic solvent water stream 380 and a bottom asphaltenes, water, mineral solids, residual heavy oil, residual paraffinic solvent stream 390. Stream 390 is further sent to treatment. Paraffinic solvent water stream 380 is processed in reflux drum 400, producing paraffinic solvent stream 410 and water stream 405. Water stream 405 is sent for further treatment. Stream 410 is combined with additional recovered paraffinic solvent stream 260 and make-up paraffinic solvent stream 280 resulting in paraffinic solvent stream 290. Paraffinic solvent stream 290 is split into paraffinic solvent streams 60, 100 and 300.

Figure 2:
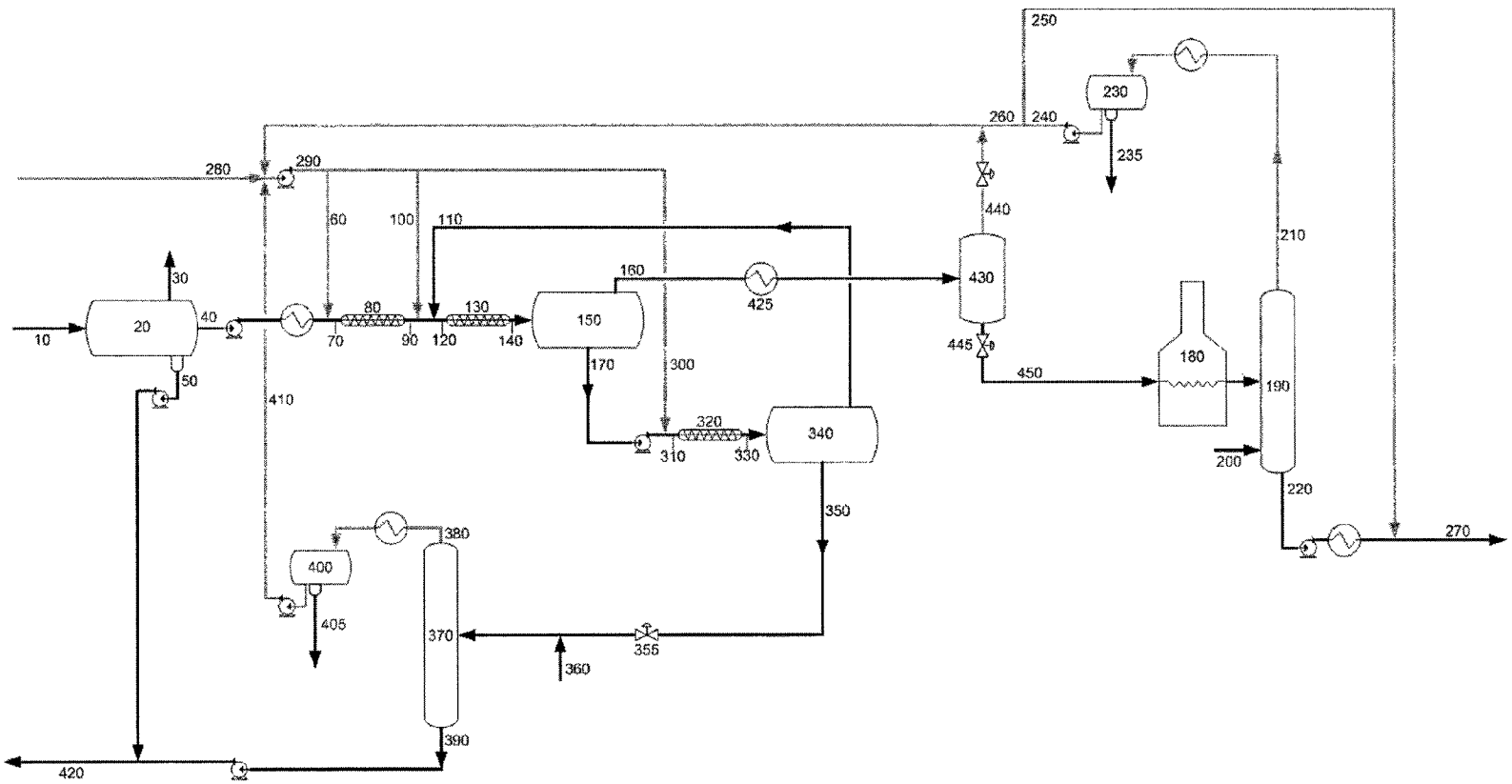
FIG. 2 depicts the system of FIG. 1 with the addition of a supercritical paraffinic solvent recovery step.

Referring now to FIG. 2, the process is similar to the process of FIG. 1 with the addition of a supercritical paraffinic solvent recovery step between primary separator 150 and heater 180. The supercritical paraffinic solvent recovery step is an energy efficient mode of paraffinic solvent recovery resulting in a paraffinic solvent reduced stream into fractionator 190. Overflow stream 160 from primary separator 150 is heated via heater 425 and fed into a supercritical paraffinic solvent recovery unit 430, producing a paraffinic solvent stream 440 and a de-asphalted oil, residual paraffinic solvent stream 450. Stream 450 is fed into heater 180 as per FIG. 1. Paraffinic solvent stream 440 is combined with paraffinic solvent stream 260.

For a description of other components depicted in FIG. 2 reference is made to FIG. 1.

Figure 3:
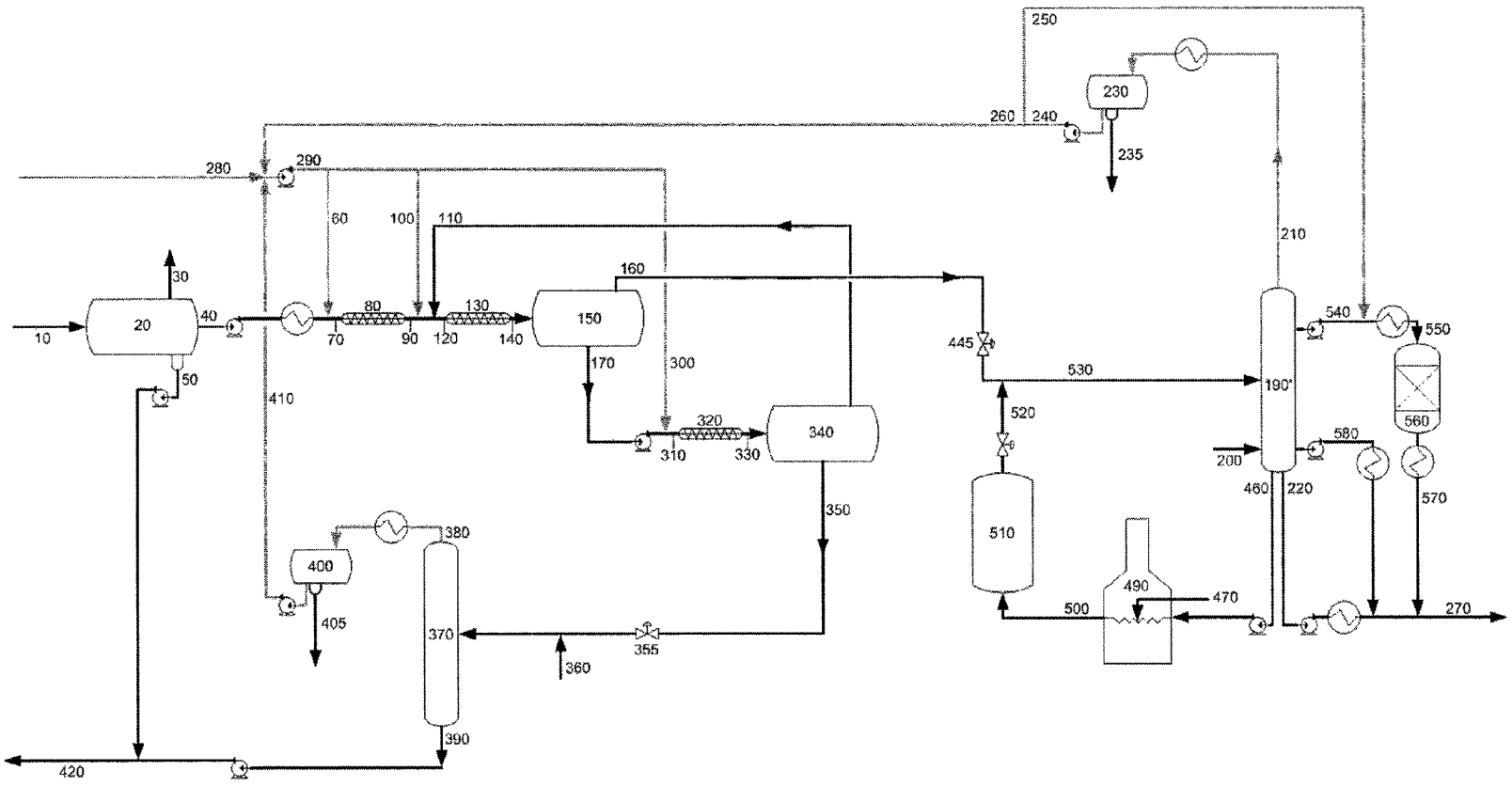
FIG. 3 depicts the system of FIG. 1 with the addition of a cracking step and an olefins treating step.

Referring now to FIG. 3, the process is similar to the process of FIG. 1 with the addition of a cracking step and an olefins treating step as well as the removal of heater 180. Stream 160 in this Figure is mixed with another stream resulting from a cracker, consisting of a heater 490 and a soaker 510 before entering fractionator 190'. Fractionator 190' results in two bottom heavy residue fraction streams, 220 and 460. Stream 460 and steam 470 are fed into a heater 490 resulting in a heated stream 500 which is fed into soaker 510, resulting in a cracked stream 520. Cracked stream 520 is mixed into overflow stream 160 forming stream 530, which is introduced into fractionator 190' resulting in paraffinic solvent water stream 210, light distillate stream 540, heavy distillate (HGO) stream 580, and the two bottom heavy residue fraction streams 220 and 460. Light distillate stream 540 is combined with paraffinic solvent stream 250 forming stream 550. Stream 550 is fed into an olefins treating unit 560, resulting in a low olefin and low di-olefin content stream 570. Streams 570, 580 and 220 are combined, forming an upgraded oil stream 270.

For a description of other components depicted in FIG. 3 reference is made to FIG. 1.

Figure 4:
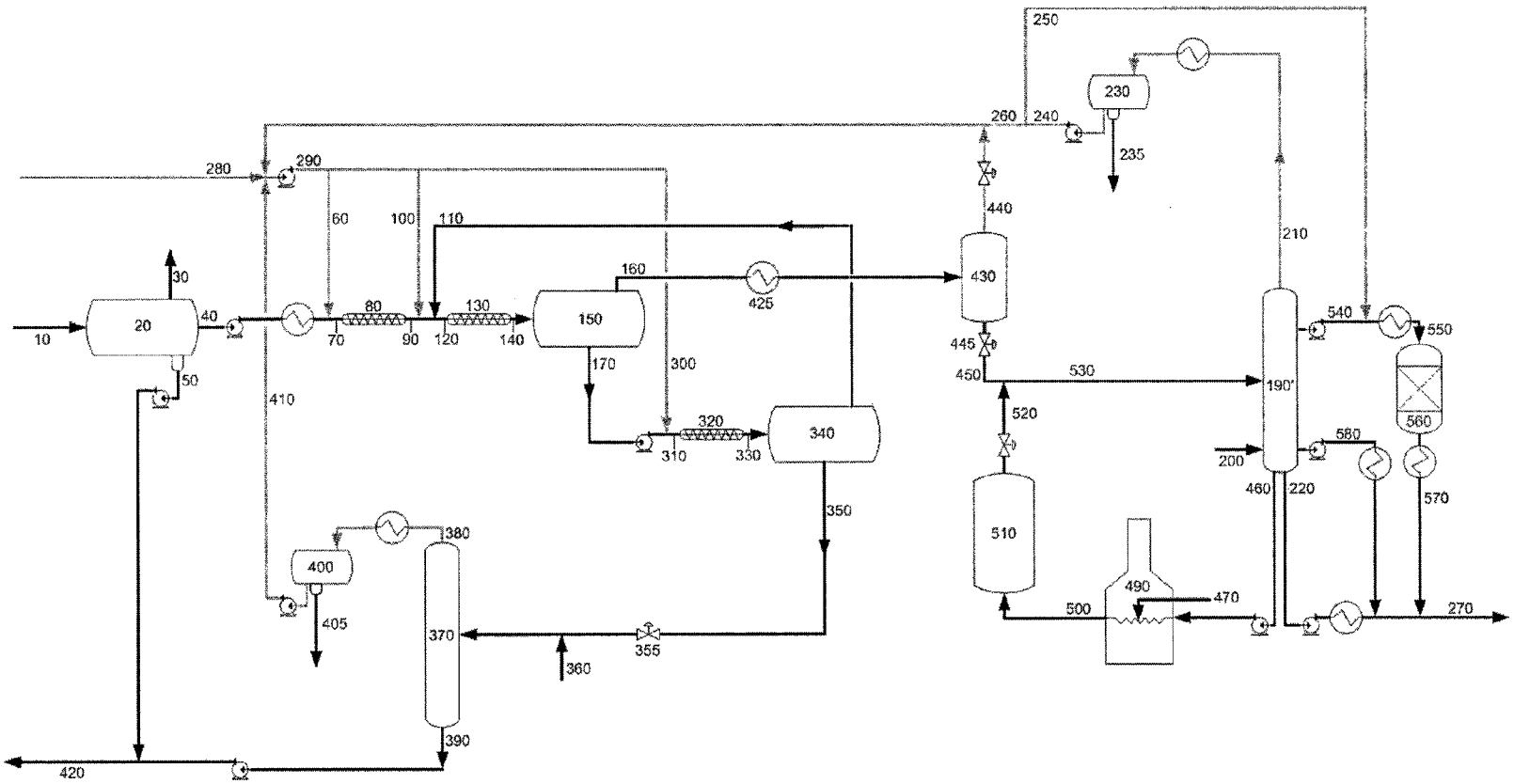
FIG. 4 depicts the system of FIG. 3 with the addition of a supercritical paraffinic solvent recovery step.

Referring now to FIG. 4, the system is similar to FIG. 3 except a supercritical paraffinic solvent recovery step is added between primary separator 150 and fractionator 190' of FIG. 3. Overflow stream 160 from primary separator 150 is heated via heater 425 and fed into a supercritical paraffinic solvent recovery unit 430, producing a paraffinic solvent stream 440 and a de-asphalted oil, residual paraffinic solvent stream 450. Stream 450 is combined with cracked stream 520 resulting in stream 530. Stream 440 is added to paraffinic solvent stream 260.

For a description of other components depicted in FIG. 4 reference is made to FIGS. 1, 2 and 3 described above.

Figure 5:
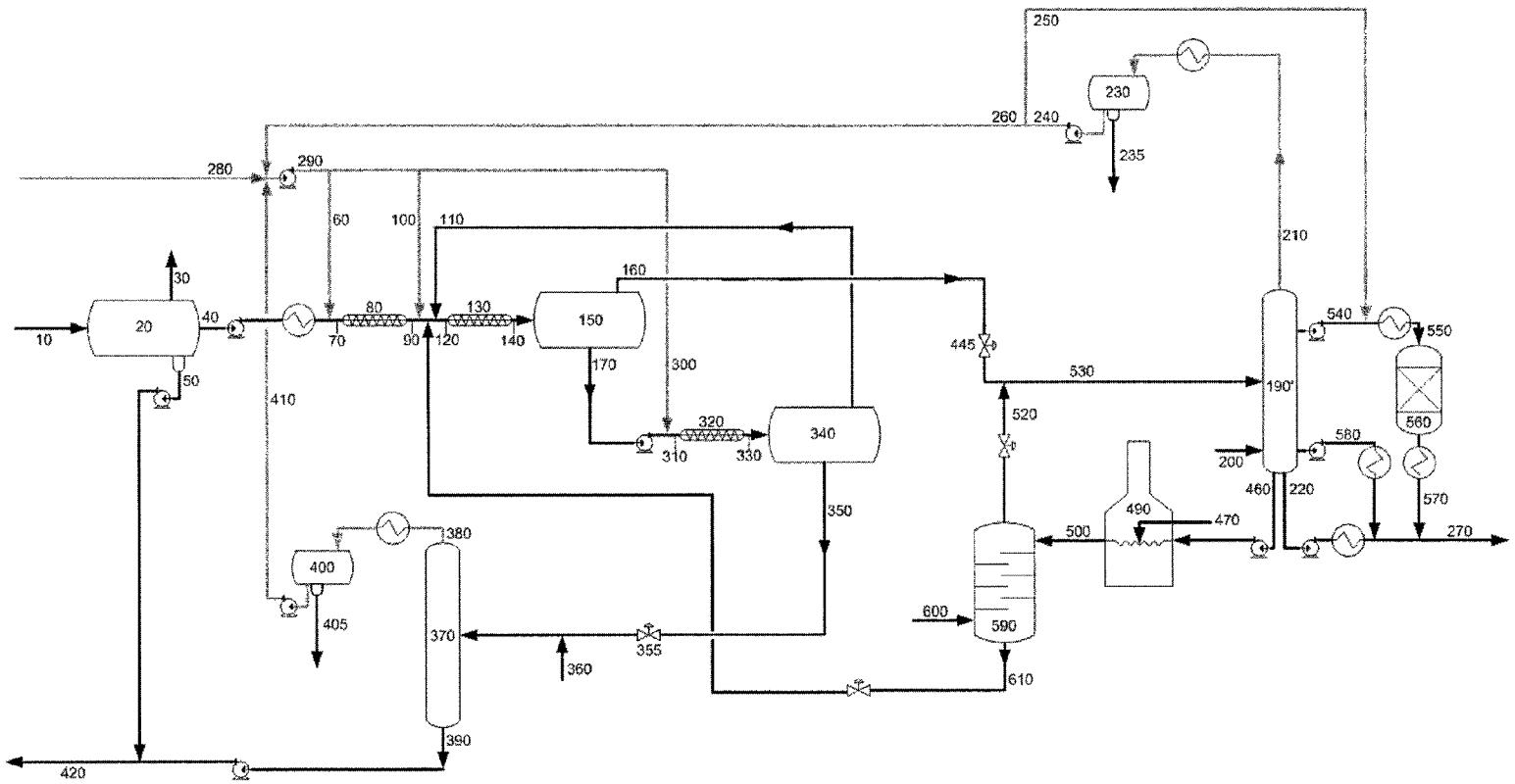
FIG. 5 depicts the system of FIG. 3 with the replacement of the soaker with a high efficiency soaker.

Referring now to FIG. 5, the process is similar to the process of FIG. 3 with the replacement of soaker 510 with a high efficiency soaker 590 resulting in an asphaltenes, gases and olefins content reduced stream into fractionator 190'. Heated stream 500 and steam 600 are fed into high efficiency soaker 590, resulting in a top light cracked stream 520 and a bottom heavy cracked stream 610. Top light cracked stream 520 is mixed into overflow stream 160 forming stream 530, which is introduced into fractionator 190' resulting in a paraffinic solvent water stream 210, light distillate stream 540, heavy distillate (HGO) stream 580, and the two bottom heavy residue fraction streams 220 and 460. Bottom heavy cracked stream 610 is combined with stream 110 prior to mixer 130 and fed into primary separator 150.

For a description of other components depicted in FIG. 5 reference is made to FIG. 3 described above.

Figure 6:
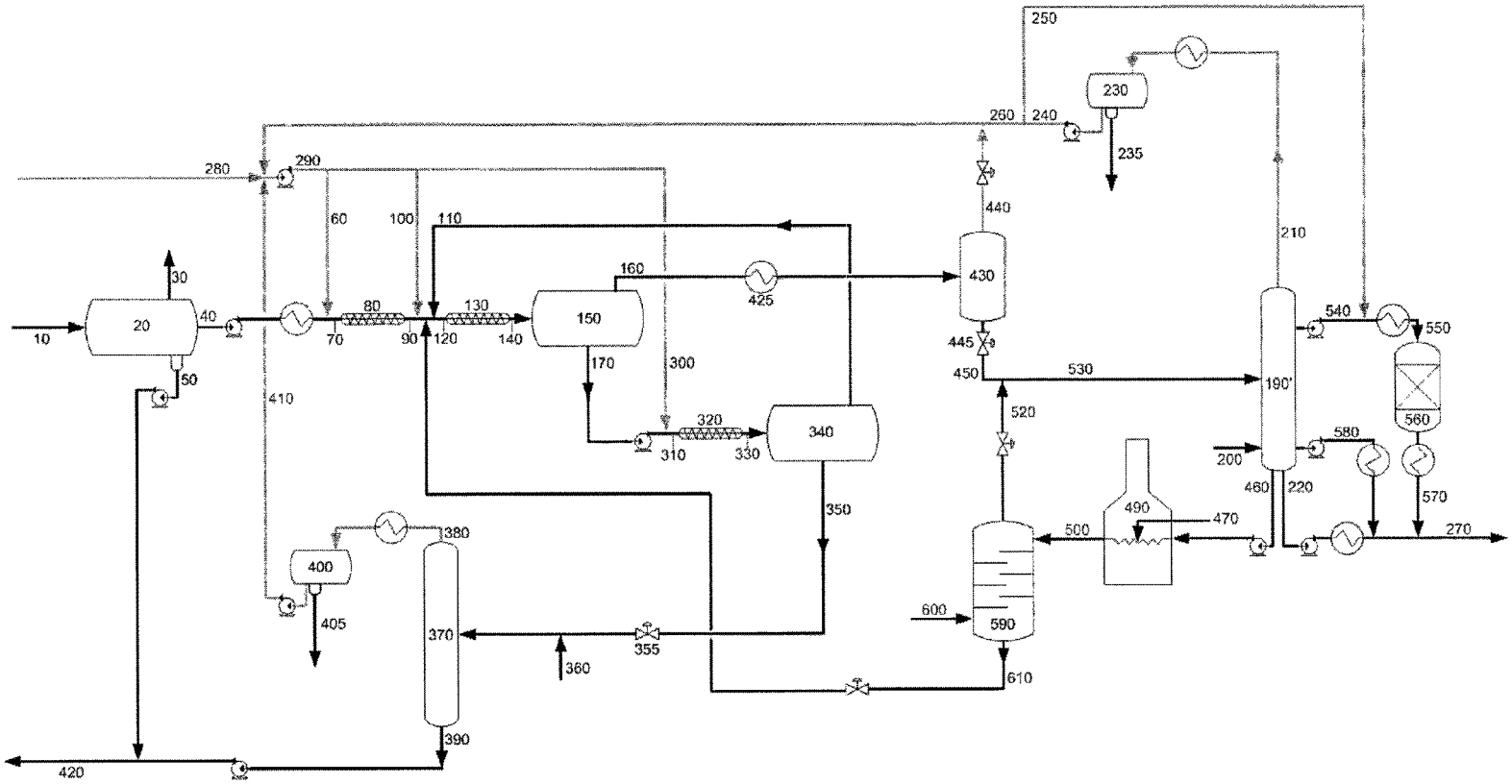
FIG. 6 depicts the system of FIG. 5 with the addition of a supercritical paraffinic solvent recovery step.

Referring now to FIG. 6, the system is similar to FIG. 5 except a supercritical paraffinic solvent recovery step is added between primary separator 150 and fractionator 190' of FIG. 5. Overflow stream 160 from primary separator 150 is heated via heater 425 and fed into a supercritical paraffinic solvent recovery unit 430, producing a paraffinic solvent stream 440 and a de-asphalted oil, residual paraffinic solvent stream 450. Stream 450 is combined with light cracked stream 520 resulting in stream 530 which is fed into fractionator 190'. Stream 440 is added to paraffinic solvent stream 260.

For a description of other components depicted in FIG. 6 reference is made to FIG. 5 described above.

In any of the above Figures, for the generation of water droplets, a water feed 65 is introduced into primary separator 150 and secondary separator 340 (see FIG. 1).

EXAMPLES

The present invention is further illustrated in the following examples.

TABLE 1

Heavy Oil Recovery (Asphaltenes + Water + Mineral Solids Separation)

| | Feed Athabasca Bitumen | Heavy Oil Recovery (Asphaltenes + Water + Mineral Solids Separation) | | | | | | | |
|---|---|---|---|---|---|---|---|---|---|
| | 25% w Bitumen, 75% w Water | Example 1.1 | | Example 1.2 | | Example 1.3 | | Example 1.4 | |
| Paraffinic Solvent | | n-Pentane | | Condensate | | n-Hexane | | n-Heptane | |
| Paraffinic Solvent sp.gr. @ 15.56° C. | | 0.6310 | | 0.6540 | | 0.6638 | | 0.6882 | |
| Extraction T, ° C. | | 80 | | 80 | | 80 | | 80 | |
| Paraffinic Solvent/Bitumen, w/w | | 3.09 | | 5.60 | | 4.14 | | 4.37 | |
| | | Recovered Oil | Asphaltenes | Recovered Oil | Asphaltenes | Recovered Oil | Asphaltenes | Recovered Oil | Asphaltenes |
| Recovered, % w | | 83.30 | 16.70 | 83.61 | 16.39 | 83.45 | 16.55 | 83.45 | 16.55 |
| Recovered, % v | | 85.97 | 14.03 | 86.23 | 13.77 | 86.10 | 13.90 | 86.10 | 13.90 |
| API | 8.00 | 12.47 | | 12.38 | | 12.42 | | 12.42 | |
| sp.gr. @ 15.56° C. | 1.0143 | 0.9829 | 1.2071 | 0.9834 | 1.2078 | 0.9832 | 1.2075 | 0.9832 | 1.2075 |
| Viscosity, cSt @ 7.5° C. | 8.2E+06 | 47430 | | 53460 | | 49280 | | 47640 | |
| Viscosity, cSt @ 20° C. | 7.9E+05 | 8810 | | 9750 | | 9100 | | 8840 | |
| MCR, % w | 14.33 | 7.17 | 50.04 | 7.25 | 50.44 | 7.21 | 50.24 | 7.21 | 50.24 |
| C5-Insoluble Asphaltenes, % w | 15.47 | 1.31 | 86.10 | 1.85 | 84.95 | 1.45 | 86.18 | 1.24 | 87.24 |
| Composition, % w | | | | | | | | | |
| C | 83.62 | 84.16 | 80.96 | 84.16 | 80.90 | 84.16 | 80.93 | 84.16 | 80.93 |
| H | 10.28 | 10.75 | 7.92 | 10.74 | 7.91 | 10.74 | 7.91 | 10.74 | 7.91 |
| S | 4.84 | 4.32 | 7.45 | 4.33 | 7.46 | 4.32 | 7.46 | 4.32 | 7.46 |
| N | 0.47 | 0.31 | 1.24 | 0.31 | 1.26 | 0.31 | 1.25 | 0.31 | 1.25 |
| O | 0.76 | 0.45 | 2.28 | 0.45 | 2.31 | 0.45 | 2.29 | 0.45 | 2.29 |
| Ni + V, ppmw | 344 | 104 | 1544 | 104 | 1569 | 104 | 1557 | 104 | 1557 |

| | Feed Athabasca Bitumen | Heavy Oil Recovery (Asphaltenes + Water + Mineral Solids Separation) | | | |
|---|---|---|---|---|---|
| | 25% w Bitumen, 75% w Water | Example 2.1 | Example 2.2 | Example 2.3 | Example 2.4 |
| Paraffinic Solvent | | n-Pentane | Condensate | n-Hexane | n-Heptane |
| Paraffinic Solvent sp.gr. @ 15.56° C. | | 0.6310 | 0.6540 | 0.6638 | 0.6882 |
| Extraction T, ° C. | | 100 | 100 | 100 | 100 |
| Paraffinic Solvent/Bitumen, w/w | | 2.83 | 5.29 | 4.03 | 4.45 |

TABLE 1-continued

| | | Heavy Oil Recovery (Asphaltenes + Water + Mineral Solids Separation) | | | | | | | |
|---|---|---|---|---|---|---|---|---|---|
| | | Recovered Oil | Asphaltenes | Recovered Oil | Asphaltenes | Recovered Oil | Asphaltenes | Recovered Oil | Asphaltenes |
| Recovered, % w | | 83.45 | 16.55 | 83.76 | 16.24 | 83.61 | 16.39 | 83.92 | 16.08 |
| Recovered, % v | | 86.10 | 13.90 | 86.37 | 13.63 | 86.23 | 13.77 | 86.50 | 13.50 |
| API | 8.00 | 12.42 | | 12.34 | | 12.38 | | 12.30 | |
| sp.gr. @ 15.56° C. | 1.0143 | 0.9832 | 1.2075 | 0.9837 | 1.2082 | 0.9834 | 1.2078 | 0.9840 | 1.2086 |
| Viscosity, cSt @ 7.5° C. | 8.2E+06 | 47560 | | 54030 | | 51250 | | 50480 | |
| Viscosity, cSt @ 20° C. | 7.9E+05 | 8830 | | 9850 | | 9410 | | 9300 | |
| MCR, % w | 14.33 | 7.21 | 50.24 | 7.29 | 50.65 | 7.25 | 50.65 | 7.37 | 51.07 |
| C5-Insoluble Asphaltenes, % w | 15.47 | 1.23 | 87.27 | 1.82 | 85.87 | 1.59 | 86.28 | 1.30 | 89.40 |
| Composition, % w | | | | | | | | | |
| C | 83.62 | 84.16 | 80.93 | 84.16 | 80.88 | 84.16 | 80.90 | 84.16 | 80.85 |
| H | 10.28 | 10.74 | 7.91 | 10.74 | 7.91 | 10.74 | 7.91 | 10.73 | 7.90 |
| S | 4.84 | 4.32 | 7.46 | 4.33 | 7.47 | 4.33 | 7.46 | 4.34 | 7.48 |
| N | 0.47 | 0.31 | 1.25 | 0.31 | 1.27 | 0.31 | 1.26 | 0.31 | 1.28 |
| O | 0.76 | 0.45 | 2.29 | 0.45 | 2.32 | 0.45 | 2.31 | 0.45 | 2.33 |
| Ni + V, ppmw | 344 | 104 | 1557 | 104 | 1582 | 104 | 1570 | 105 | 1595 |

| | Feed Athabasca Bitumen | Heavy Oil Recovery (Asphaltenes + Water + Mineral Solids Separation) | | | | | | | |
|---|---|---|---|---|---|---|---|---|---|
| | 25% w Bitumen, 75% w Water | Example 3.1 | | Example 3.2 | | Example 3.3 | | Example 3.4 | |
| Paraffinic Solvent | | n-Pentane | | Condensate | | n-Hexane | | n-Heptane | |
| Paraffinic Solvent sp.gr. @ 15.56° C. | | 0.6310 | | 0.6540 | | 0.6638 | | 0.6882 | |
| Extraction T, ° C. | | 130 | | 130 | | 130 | | 130 | |
| Paraffinic Solvent/Bitumen, w/w | | 2.29 | | 4.41 | | 3.64 | | 4.45 | |
| | | Recovered Oil | Asphaltenes | Recovered Oil | Asphaltenes | Recovered Oil | Asphaltenes | Recovered Oil | Asphaltenes |
| Recovered, % w | | 83.76 | 16.24 | 84.07 | 15.93 | 83.76 | 16.24 | 84.23 | 15.77 |
| Recovered, % v | | 86.37 | 13.63 | 86.63 | 13.37 | 86.37 | 13.63 | 86.77 | 13.23 |
| API | 8.00 | 12.34 | | 12.25 | | 12.34 | | 12.21 | |
| sp.gr. @ 15.56° C. | 1.0143 | 0.9837 | 1.2082 | 0.9843 | 1.2089 | 0.9837 | 1.2082 | 0.9846 | 1.2093 |
| Viscosity, cSt @ 7.5° C. | 8.2E+06 | 48240 | | 52870 | | 51380 | | 53310 | |
| Viscosity, cSt @ 20° C. | 7.9E+05 | 8940 | | 9670 | | 9430 | | 9740 | |
| MCR, % w | 14.33 | 7.29 | 50.65 | 7.37 | 51.07 | 7.29 | 50.65 | 7.41 | 51.28 |
| C5-Insoluble Asphaltenes, % w | 15.47 | 1.12 | 89.48 | 1.49 | 89.25 | 1.51 | 87.48 | 1.44 | 90.41 |

TABLE 1-continued

| Heavy Oil Recovery (Asphaltenes + Water + Mineral Solids Separation) | | | | | | | | | |
|---|---|---|---|---|---|---|---|---|---|
| Composition, % w | | | | | | | | | |
| C | 83.62 | 84.16 | 80.88 | 84.16 | 80.82 | 84.16 | 80.88 | 84.16 | 80.79 |
| H | 10.28 | 10.74 | 7.91 | 10.73 | 7.90 | 10.74 | 7.91 | 10.72 | 7.90 |
| S | 4.84 | 4.33 | 7.47 | 4.34 | 7.49 | 4.33 | 7.47 | 4.34 | 7.50 |
| N | 0.47 | 0.31 | 1.27 | 0.31 | 1.28 | 0.31 | 1.27 | 0.31 | 1.29 |
| O | 0.76 | 0.45 | 2.32 | 0.45 | 2.35 | 0.45 | 2.32 | 0.46 | 2.36 |
| Ni + V, ppmw | 344 | 104 | 1582 | 105 | 1609 | 104 | 1582 | 105 | 1623 |

| | Feed Athabasca Bitumen | Heavy Oil Recovery (Asphaltenes + Water + Mineral Solids Separation) | | | | | | | |
|---|---|---|---|---|---|---|---|---|---|
| | 25% w Bitumen, 75% w Water | Example 4.1 | | Example 4.2 | | Example 4.3 | | Example 4.4 | |
| Paraffinic Solvent | | n-Pentane | | Condensate | | n-Hexane | | n-Heptane | |
| Paraffinic Solvent sp.gr. @ 15.56° C. | | 0.6310 | | 0.6540 | | 0.6638 | | 0.6882 | |
| Extraction T, ° C. | | 180 | | 180 | | 180 | | 180 | |
| Paraffinic Solvent/Bitumen, w/w | | 1.30 | | 2.48 | | 2.46 | | 3.70 | |
| | | Recovered Oil | Asphaltenes | Recovered Oil | Asphaltenes | Recovered Oil | Asphaltenes | Recovered Oil | Asphaltenes |
| Recovered, % w | | 83.92 | 16.08 | 84.38 | 15.62 | 84.07 | 15.93 | 84.38 | 15.62 |
| Recovered, % v | | 86.50 | 13.50 | 86.90 | 13.10 | 86.63 | 13.37 | 86.90 | 13.10 |
| API | 8.00 | 12.30 | | 12.17 | | 12.25 | | 12.17 | |
| sp.gr. @ 15.56° C. | 1.0143 | 0.9840 | 1.2086 | 0.9849 | 1.2096 | 0.9843 | 1.2089 | 0.9849 | 1.2096 |
| Viscosity, cSt @ 7.5° C. | 8.2E+06 | 45240 | | 49510 | | 48290 | | 54670 | |
| Viscosity, cSt @ 20° C. | 7.9E+05 | 8470 | | 9150 | | 8950 | | 9950 | |
| MCR, % w | 14.33 | 7.33 | 50.86 | 7.45 | 51.50 | 7.37 | 51.07 | 7.45 | 51.50 |
| C5-Insoluble Asphaltenes, % w | 15.47 | 0.62 | 92.97 | 0.89 | 94.23 | 0.93 | 92.20 | 1.50 | 90.94 |
| Composition, % w | | | | | | | | | |
| C | 83.62 | 84.16 | 80.85 | 84.15 | 80.76 | 84.16 | 80.82 | 84.15 | 80.76 |
| H | 10.28 | 10.73 | 7.90 | 10.72 | 7.89 | 10.73 | 7.90 | 10.72 | 7.89 |
| S | 4.84 | 4.34 | 7.48 | 4.35 | 7.51 | 4.34 | 7.49 | 4.35 | 7.51 |
| N | 0.47 | 0.31 | 1.28 | 0.31 | 1.30 | 0.31 | 1.28 | 0.31 | 1.30 |
| O | 0.76 | 0.45 | 2.33 | 0.46 | 2.37 | 0.45 | 2.35 | 0.46 | 2.37 |
| Ni + V, ppmw | 344 | 105 | 1595 | 105 | 1636 | 105 | 1609 | 105 | 1636 |

TABLE 2

System of FIG. 1 vs. Prior Art System

Example 5

| | Feed | Heavy Oil Recovery | | Field Upgrader Products | |
|---|---|---|---|---|---|
| | Athabasca Bitumen 25% w Bitumen, 75% w Water | | | | |
| Paraffinic Solvent | | Condensate | | | |
| Paraffinic Solvent sp. gr. @ 15.56° C. | | 0.6540 | | | |
| Extraction T, ° C. | | 100 | | | |
| Paraffinic Solvent/Bitumen, w/w | | 5.29 | | | |
| Diluent | | | | Condensate | |
| Diluent/Recovered Oil (DAO), w/w | | | | 0.20 | |
| Diluent % v | | | | 23 | |
| | | Recovered Oil (DAO) | Asphaltenes | Total Asphaltenes Rejected | Upgraded Oil |
| Properties | | | | | |
| Weight on Bitumen, % w | 100.00 | 83.76 | 16.24 | 16.24 | 100.51 |
| Volume on Bitumen, % v | 100.00 | 86.37 | 13.63 | 13.63 | 112.65 |
| API | 8.00 | 12.34 | | | 23.03 |
| sp. gr. @ 15.56° C. | 1.0143 | 0.9837 | 1.2082 | 1.2082 | 0.9157 |
| Viscosity, cSt @ 7.5° C. | 8.2E+06 | 54030 | | | 350 |
| Viscosity, cSt @ 20° C. | 7.9E+05 | 9850 | | | 148 |
| MCR, % w | 14.33 | 7.29 | 50.65 | 50.65 | 6.08 |
| C5-Insoluble Asphaltenes, % w | 15.47 | 1.82 | 85.87 | 85.87 | 1.52 |
| Composition, % w | | | | | |
| C | 83.62 | 84.16 | 80.88 | 80.88 | 85.52 |
| H | 10.28 | 10.74 | 7.91 | 7.91 | 10.23 |
| S | 4.84 | 4.33 | 7.47 | 7.47 | 3.61 |
| N | 0.47 | 0.31 | 1.27 | 1.27 | 0.26 |
| O | 0.76 | 0.45 | 2.32 | 2.32 | 0.38 |
| Ni + V, ppmw | 344 | 104 | 1582 | 1582 | 87 |

Prior Art

| | Feed | Diluted Bitumen | |
|---|---|---|---|
| | Athabasca Bitumen 25% w Bitumen. 75% w Water | | |
| Paraffinic Solvent | | | |
| Paraffinic Solvent sp. gr.@ 15.56° C. | | | |
| Extraction T, ° C. | | | |
| Paraffinic Solvent/Bitumen, w/w | | | |
| Diluent | | Condensate | |
| Diluent/Bitumen, w/w | | 0.32 | |
| Diluent % v | | 34 | |
| | | Total Asphaltenes Rejected | Dilbit |
| Properties | | | |
| Weight on Bitumen, % w | 100.00 | 0.00 | 132.49 |
| Volume on Bitumen, % v | 100.00 | | 150.38 |
| API | 8.00 | | 25.25 |
| sp. gr.@ 15.56° C. | 1.0143 | | 0.9027 |
| Viscosity, cSt @ 7.5° C. | 8.2E+06 | | 350 |
| Viscosity, cSt @ 20° C. | 7.9E+05 | | 158 |
| MCR, % w | 14.33 | | 10.82 |
| C5-Insoluble Asphaltenes, % w | 15.47 | | 11.68 |
| Composition, % w | | | |
| C | 83.62 | | 85.75 |
| H | 10.28 | | 9.64 |
| S | 4.84 | | 3.65 |
| N | 0.47 | | 0.35 |
| O | 0.76 | | 0.57 |
| Ni + V, ppmw | 344 | | 260 |

TABLE 3

| | System of FIG. 3 Example 6 | | | | | |
|---|---|---|---|---|---|---|
| | Feed | Heavy Oil Recovery | DAO Bypassing Thermal Cracker | Thermal Cracking | Olefins Treating-Alkylation | Field Upgrader Products |
| | Athabasca Bitumen 25% w Bitumen, 75% w Water | | | | | |
| Paraffinic Solvent | | Condensate | | | | |
| Paraffinic Solvent sp.gr. @ 15.56° C. | | 0.6540 | | | | |
| Extraction T, ° C. | | 180 | | | | |
| Paraffinic Solvent/Bitumen, w/w | | 2.48 | | | | |
| Heavy DAO 454° C. + Bypassing Thermal Cracker, % w | | | 7 | | | |
| Thermal Conversion of 560° C. + Fraction: | | | | | | |
| Total, % w | | | | 95* | | |
| Per Pass, % w | | | | 55 | | |
| Recycle Ratio w/w | | | | 4.5 | | |
| LHSV, $h^{-1}$ | | | | 5 | | |
| WABT, ° C. | | | | 442 | | |
| Olefins Conversion, % w | | | | | 100 | |
| Olefins Treating Product Volume Loss, % v | | | | | 3.51 | |

TABLE 3-continued

| System of FIG. 3 Example 6 | | | | | | | | | | | | | | |
|---|---|---|---|---|---|---|---|---|---|---|---|---|---|---|
| | Feed | Heavy Oil Recovery | | DAO Bypassing Thermal Cracker | | Thermal Cracking | | | | Olefins Treating-Alkylation | | | Field Upgrader Products | |
| | | Recovered Oil (DAO) | Asphaltenes | Light DAO 454° C.− | Heavy DAO 454° C.+ | Heavy DAO 454° C.+ Feed | C3− Gas Products | C4+ Oil Products | Asphaltenes Rejected | C4− 343° C. Feed | Olefins Alkylation Products | C3− Gas | Total Asphaltenes Rejected | Upgraded Oil |
| Properties | | | | | | | | | | | | | | |
| Weight on Bitumen, % w | 100.00 | 84.38 | 15.62 | 32.16 | 3.61 | 48.61 | 3.34 | 45.27 | 0.00 | 30.50 | 30.50 | 3.34 | 15.62 | 81.04 |
| Volume on Bitumen, % v | 100.00 | 86.90 | 13.10 | 35.29 | 3.57 | 48.04 | | 50.58 | | 35.73 | 34.47 | | 13.10 | 87.60 |
| API | 8.00 | 12.17 | | 21.59 | 6.37 | 6.37 | | 22.55 | | 31.96 | 26.19 | | | 19.29 |
| sp.gr. @ 15.56° C. | 1.0143 | 0.9849 | 1.2096 | 0.9243 | 1.0263 | 1.0263 | | 0.9185 | | 0.8659 | 0.8974 | | 1.2096 | 0.9384 |
| Viscosity, cSt @ 7.5° C. | 8.2E+06 | 49510 | | 51 | 5.3E+08 | 5.3E+08 | | 136 | | 4 | 10 | | | 286 |
| Viscosity, cSt @ 20° C. | 7.9E+05 | 9150 | | 28 | 2.2E+07 | 2.2E+07 | | 62 | | 3 | 7 | | | 126 |
| MCR, % w | 14.33 | 7.45 | 51.50 | 0.00 | 12.03 | 12.03 | | 13.48 | | 0.00 | 0.00 | | 51.50 | 8.07 |
| C5-Insoluble Asphaltenes, % w | 15.47 | 0.89 | 94.23 | 0.00 | 1.44 | 1.44 | | 8.88 | | 0.00 | 0.00 | | 94.23 | 5.02 |
| Composition, % w | | | | | | | | | | | | | | |
| C | 83.62 | 84.15 | 80.76 | 85.41 | 83.38 | 83.38 | | 85.21 | | 86.17 | 86.17 | | 80.76 | 85.21 |
| H | 10.28 | 10.72 | 7.89 | 11.48 | 10.25 | 10.25 | | 9.65 | | 10.99 | 10.99 | | 7.89 | 10.40 |
| S | 4.84 | 4.35 | 7.51 | 2.92 | 5.22 | 5.22 | | 3.96 | | 2.62 | 2.62 | | 7.51 | 3.61 |
| N | 0.47 | 0.31 | 1.30 | 0.10 | 0.45 | 0.45 | | 0.49 | | 0.09 | 0.09 | | 1.30 | 0.33 |
| O | 0.76 | 0.46 | 2.37 | 0.09 | 0.68 | 0.68 | | 0.67 | | 0.13 | 0.13 | | 2.37 | 0.44 |
| Ni + V, ppmw | 344 | 105 | 1636 | 0 | 169 | 169 | | 204 | | 0 | 0 | | 1636 | 121 |

Note*: 454° C.+ material is recycled until stated total 560° C.+ conversion is achieved.

TABLE 4

| System of FIG. 5 Example 7 | | | | | | |
|---|---|---|---|---|---|---|
| | Feed | Heavy Oil Recovery | DAO Bypassing Thermal Cracker | Thermal Cracking | Olefins Treating-Alkylation | Field Upgrader Products |
| | Athabasca Bitumen 25% w Bitumen, 75% w Water | | | | | |
| Paraffinic Solvent | | n-Pentane | | | | |
| Paraffinic Solvent sp.gr. @ 15.56° C. | | 0.6310 | | | | |
| Extraction T, ° C. | | 80 | | | | |
| Paraffinic Solvent/ Bitumen, w/w | | 3.09 | | | | |
| Heavy DAO 454° C.+ Bypassing Thermal Cracker, % w | | | 7 | | | |
| Thermal Conversion of 560° C.+ Fraction: | | | | | | |
| Total, % w | | | | 95* | | |
| Per Pass, % w | | | | 45 | | |
| Recycle Ratio w/w | | | | 4.7 | | |
| LHSV, $h^{-1}$ | | | | 1 | | |
| WABT, ° C. | | | | 407 | | |
| Olefins Conversion, % w | | | | | 100 | |
| Olefins Treating Product Volume Loss, % v | | | | | 3.31 | |

TABLE 4-continued

| System of FIG. 5 Example 7 | | | | | | | | | | | | | | |
|---|---|---|---|---|---|---|---|---|---|---|---|---|---|---|
| | Feed | Heavy Oil Recovery | | DAO Bypassing Thermal Cracker | | Thermal Cracking | | | | Olefins Treating-Alkylation | | Field Upgrader Products | | |
| | | Recovered Oil (DAO) | Asphaltenes | Light DAO 454° C.− | Heavy DAO 454° C.+ | Heavy DAO 454° C.+ Feed | C3− Gas Products | C4+ Oil Products | Asphaltenes Rejected | C4− 343° C. Feed | Olefins Alkylation Products | C3− Gas | Total Asphaltenes Rejected | Upgraded Oil |
| Properties | | | | | | | | | | | | | | |
| Weight on Bitumen, % w | 100.00 | 83.30 | 16.70 | 32.16 | 3.54 | 47.60 | 2.81 | 40.84 | 3.95 | 27.85 | 27.85 | 2.81 | 20.66 | 76.54 |
| Volume on Bitumen, % v | 100.00 | 85.97 | 14.03 | 35.29 | 3.51 | 47.16 | | 46.16 | 3.41 | 32.55 | 31.48 | | 17.44 | 83.46 |
| API | 8.00 | 12.47 | | 21.59 | 6.73 | 6.73 | | 24.75 | | 31.58 | 26.19 | | | 20.62 |
| sp.gr. @ 15.56° C. | 1.0143 | 0.9829 | 1.2071 | 0.9243 | 1.0237 | 1.0237 | | 0.9056 | 1.1759 | 0.8677 | 0.8973 | | 1.2010 | 0.9302 |
| Viscosity, cSt @ 7.5° C. | 8.2E+06 | 47430 | | 51 | 6.0E+08 | 6.0E+08 | | 58 | | 4 | 10 | | | 153 |
| Viscosity, cSt @ 20° C. | 7.9E+05 | 8810 | | 28 | 2.4E+07 | 2.4E+07 | | 30 | | 3 | 7 | | | 74 |
| MCR, % w | 14.33 | 7.17 | 50.04 | 0.00 | 11.67 | 11.67 | | 9.66 | 52.77 | 0.00 | 0.00 | | 50.57 | 5.70 |
| C5-Insoluble Asphaltenes, % w | 15.47 | 1.31 | 86.10 | 0.00 | 2.13 | 2.13 | | 0.00 | 92.66 | 0.00 | 0.00 | | 87.31 | 0.10 |
| Composition, % w | | | | | | | | | | | | | | |
| C | 83.62 | 84.16 | 80.96 | 85.41 | 83.38 | 83.38 | | 85.17 | 82.33 | 86.00 | 86.00 | | 81.22 | 85.19 |
| H | 10.28 | 10.75 | 7.92 | 11.48 | 10.29 | 10.29 | | 9.91 | 7.77 | 11.14 | 11.14 | | 7.89 | 10.59 |
| S | 4.84 | 4.32 | 7.45 | 2.92 | 5.20 | 5.20 | | 3.87 | 7.20 | 2.66 | 2.66 | | 7.40 | 3.53 |
| N | 0.47 | 0.31 | 1.24 | 0.10 | 0.45 | 0.45 | | 0.41 | 1.33 | 0.09 | 0.09 | | 1.26 | 0.28 |
| O | 0.76 | 0.45 | 2.28 | 0.09 | 0.67 | 0.67 | | 0.63 | 1.21 | 0.12 | 0.12 | | 2.08 | 0.41 |
| Ni + V, ppmw | 344 | 104 | 1544 | 0 | 166 | 166 | | 78 | 1573 | 0 | 0 | | 1549 | 50 |

Note*: 454° C.+ material is recycled until stated total 560° C.+ conversion is achieved.

Figure 7:
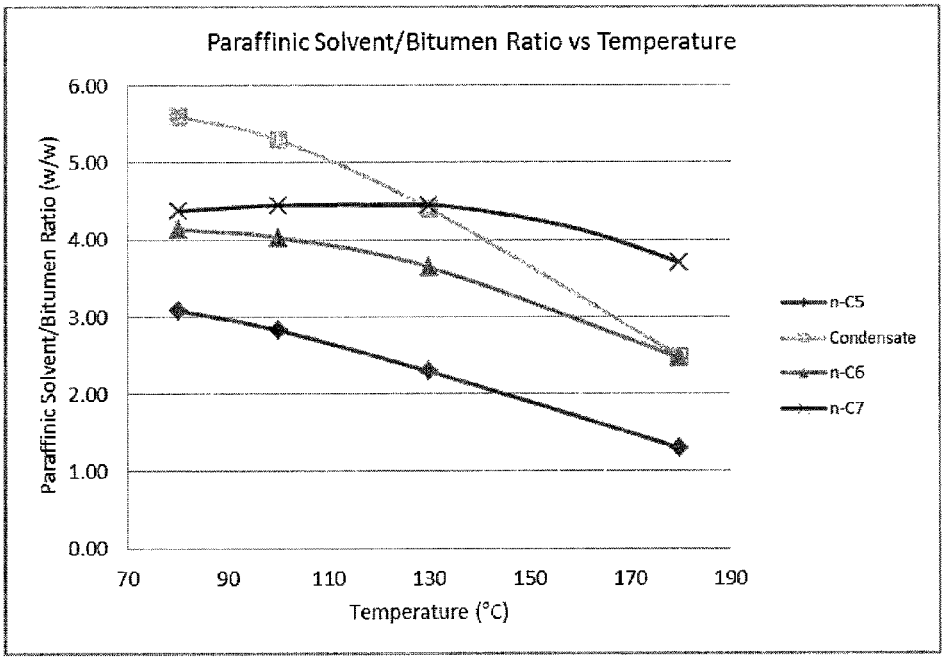
FIG. 7 shows a chart depicting paraffinic solvent/bitumen ratio vs. temperature with four paraffinic solvents being illustrated.

Examples 1.1-4.4, listed in Table 1 demonstrate the asphaltenes, water, and mineral solids separation from heavy oil under different conditions. The examples illustrate separation using four paraffinic solvents (n-C5, gas condensate, n-C6 and n-C7) at four temperatures (80° C., 100° C., 130° C. and 180° C.). The results indicate that for a preferred target of complete removal of the asphaltenes fraction, generally a lower paraffinic solvent to bitumen ratio is required as the temperature increases as it is depicted in FIG. 7. The results also show a significant improvement in the properties of the de-asphalted oil ("DAO") from the original feed, resulting in a de-asphalted oil with an increased API, reduced viscosity, and reduced micro-carbon, sulfur, nitrogen, nickel and vanadium content. The properties of the de-asphalted oil were similar in the above examples.

Example 5 shown in Table 2, compares the system of FIG. 1 with the Prior Art system. Table 2 depicts the system of FIG. 1, Athabasca bitumen treated for heavy oil, asphaltenes, water, mineral solids separation using gas condensate as the paraffinic solvent for the solvent de-asphalting step and the prior art system of upgrading Athabasca bitumen using gas condensate as a diluent, forming Dilbit (34% v condensate). As is shown, the system of the present invention results in an upgraded oil containing a lower amount of gas condensate (23% v) meeting density and viscosity values consistent with pipeline specifications as discussed herein, as well as having an economic advantage (e.g. lower gas condensate volume in the upgraded oil) compared to the prior art.

Example 6, shown in Table 3, depicts the system of FIG. 3. Athabasca bitumen was treated for heavy oil, asphaltenes, water, mineral solids separation using gas condensate as the paraffinic solvent with a paraffinic solvent to bitumen ratio of 2.48 w/w and a temperature of 180° C. resulting in a DAO.

93% w of the heavy 454° C.+ fraction of the DAO was treated through thermal cracking at a LHSV of 5 $h^{-1}$ and a weighted average bed temperature ("WABT") of 442° C. resulting in 55% w conversion of the 560° C.+ fraction per pass. Any portion of the 454° C.+ fraction remaining subsequent to thermal cracking was recycled to the thermal cracker to undergo further conversion until a stated 95% w total conversion of the 560° C.+ fraction in the original heavy 454° C.+ feed was achieved. This recycling eventually resulted in a total feed to the thermal cracker of 4.5 times the original 93% w of the heavy 454° C.+ fraction.

The light C4-343° C. cracked product together with the light C4-343° C. fraction of the DAO were sent for olefins-aromatics alkylation to achieve essentially 100% olefins conversion. The resultant olefins-aromatics alkylation product was blended with the remaining 343° C.+ fraction from both the thermal cracker and the fraction bypassing the thermal cracker resulting in the final upgraded oil.

Example 7, shown in Table 4, depicts the system of FIG. 5. Athabasca bitumen was treated for heavy oil, asphaltenes, water, mineral solids separation using gas condensate as the paraffinic solvent with a paraffinic solvent to bitumen ratio of 3.09 w/w and a temperature of 80° C. resulting in a DAO.

93% w of the heavy 454° C.+ fraction of the DAO was treated through thermal cracking at a LHSV of 1 $h^{-1}$ and a weighted average bed temperature ("WABT") of 407° C. resulting in 45% w conversion of the 560° C.+ fraction per pass. In contrast to Example 6, the incorporation of a high efficiency soaker resulted in a top light cracked stream and a bottom heavy cracked stream. The bottom heavy cracked stream consisting of both thermally cracked generated asphaltenes and other heavy hydrocarbons was recycled through the heavy oil, asphaltenes, water, mineral solids separation process allowing for the further rejection of asphaltenes and for the recovery of the other heavy hydrocarbons. Any portion of the 454° C.+ fraction remaining was recycled to the thermal cracker to undergo further conversion until a stated 95% w total conversion of the 560° C.+ fraction in the original heavy 454° C.+ feed was achieved. This recycling eventually resulted in a total feed to the thermal cracker of 4.7 times the original 93% w of the heavy 454° C.+ fraction.

The light C4-343° C. cracked product together with the light C4-343° C. fraction of the DAO were sent for olefins-aromatics alkylation to achieve essentially 100% olefins conversion. The resultant olefins-aromatics alkylation product was blended with the remaining 343° C.+ fraction from both the thermal cracker and the fraction bypassing the thermal cracker resulting in the final upgraded oil.

The data in Examples 5 through 7 show an improvement to the properties of the upgraded oil, from the original feed, with an increased API, reduced viscosity, and reduced micro-carbon, sulfur, nitrogen, nickel, vanadium and olefins content, while still exhibiting high liquid volume product yields, as well as an economic advantage, over the prior art.

As many changes can be made to the preferred embodiment of the invention without departing from the scope thereof, it is intended that all matter contained herein be considered illustrative of the invention and not in a limiting sense.

The invention claimed is:

1. A process for upgrading oil comprising:

optionally pre-treating a heavy oil, wherein said heavy oil further comprises at least one dissolved gas, asphaltenes, water, and mineral solids, reducing at least one dissolved gas content from said heavy oil, optionally further reducing water content from said heavy oil;

adding a paraffinic solvent to said heavy oil, at a predetermined paraffinic solvent:heavy oil ratio, to facilitate separation of asphaltenes, water, and mineral solids from the heavy oil, wherein separation products comprise:

a de-asphalted or partially de-asphalted oil ("DAO")-paraffinic solvent stream, comprising a low asphaltenes content DAO-paraffinic solvent stream; and an asphaltenes-mineral solids-paraffinic solvent-water slurry stream;

optionally separating the paraffinic solvent and water from the asphaltenes-mineral solids-paraffinic solvent-water slurry stream;

separating the DAO-paraffinic solvent stream by fractionation using at least one fractionating step, resulting in a paraffinic solvent rich stream, at least one distillate hydrocarbon fraction stream, and at least one heavy residue fraction stream;

optionally adding diluent to at least one heavy residue fraction stream resulting in transportable oil; and cracking a portion of said at least one heavy residue fraction stream forming at least one cracked stream.

2. The process of claim 1 further comprising at least one supercritical paraffinic solvent recovery step followed by at least one fractionating step.

3. The process of claim 1 wherein said at least one cracked stream is mixed with said DAO-paraffinic solvent stream for said at least one fractionating step.

4. The process of claim 1 wherein said cracking further comprises at least one soaker.

5. The process of claim 4 wherein said at least one soaker is selected from the group consisting of a conventional up-flow soaker and a high efficiency soaker.

6. The process of claim 5 wherein when said at least one soaker is a high efficiency soaker, and said at least one heavy residue fraction stream is cracked into a light cracked stream and a heavy cracked stream.

7. The process of claim 6 wherein said heavy cracked stream is recycled to said addition of a paraffinic solvent to said heavy oil step and said light cracked stream is mixed with said DAO-paraffinic solvent stream.

8. The process of claim 1 wherein said treating a heavy oil, to reduce at least one dissolved gas and a predetermined amount of water from the heavy oil, further comprises introducing said heavy oil to at least one separator.

9. The process of claim 8 wherein said at least one separator is selected from a gravity separator or a centrifuge.

10. The process of claim 1 wherein said cracking is carried out in a catalytic steam cracker, and at least one catalyst is added to said heavy residue fraction stream to be cracked.

11. The process of claim 10 wherein said catalyst is a nano-catalyst.

12. The process of claim 11 wherein said nano-catalyst has a particle size of from about 20 to about 120 nanometers.

13. The process of claim 12 wherein said nano-catalyst further comprises a metal selected from rare earth oxides, group IV metals, and mixtures thereof in combination with NiO, CoOx, alkali metals and $MoO_3$.

14. The process of claim 1 wherein said paraffinic solvent: heavy oil ratio is from about 0.6 to about 10.0 w/w.

15. The process of claim 14 wherein said paraffinic solvent:heavy oil ratio is from about 1.0 to about 6.0 w/w.

16. The process of claim 1 wherein said separation of asphaltenes, water, and mineral solids from the heavy oil resulting in a de-asphalted or partially de-asphalted oil ("DAO")-paraffinic solvent stream is carried out at a temperature from about ambient temperature to about critical temperature of said paraffinic solvent.

17. The process of claim 16 wherein said separation is carried out at a temperature from about 35° C. to about 267° C.

18. The process of claim 16 wherein said separation is carried out at a temperature from about 60° C. to about 200° C.

19. The process of claim 1 wherein said separation is carried out at a pressure of from about the paraffinic solvent vapour pressure to higher than the paraffinic solvent critical pressure.

20. The process of claim 19 wherein said separation is carried out at a pressure of from about 10% higher than the paraffinic solvent vapour pressure to about 20% higher than the paraffinic solvent critical pressure.

21. The process of claim 1 wherein said separation removes at least a minimum amount of asphaltenes resulting in a transportable oil.

22. The process of claim 1 wherein said separation removes at least a minimum amount of asphaltenes, prior to said cracking.

23. The process of claim 22 wherein when said cracking comprises catalytic cracking, and said separation removes at least a minimum amount of asphaltenes allowing catalytic cracking to proceed.

24. The process of claim 23 wherein said catalytic cracking is catalytic steam cracking.

25. The process of claim 23 or 24 wherein at least about 30% of n-C5 insoluble asphaltenes are removed during said separation.

26. The process of claim 1 or 4 wherein said cracking step is carried out at a temperature range of from about 300° C. to about 480° C.

27. The process of claim 26 wherein said cracking step is carried out at a temperature range of from about 400° C. to about 465° C.

28. The process of claim 1 or 4 wherein said cracking step is carried out at a pressure range of from about atmospheric pressure to about 4500 kPa.

29. The process of claim 28 wherein said cracking step is carried out at a pressure range of from about 1000 kPa to about 4000 kPa.

30. The process of claim 1 or 4 wherein said cracking step has a LHSV of from about 0.1 $h^{-1}$ to about 10 $h^{-1}$.

31. The process of claim 30 wherein said cracking step has a LHSV of from about 0.5 $h^{-1}$ to about 5 $h^{-1}$.

32. The process of claim 1 further comprising at least one mixing step prior to adding a paraffinic solvent to said heavy oil.

33. The process of claim 1 further comprising at least one supercritical paraffinic solvent recovery step.

34. The process of claim 33 wherein said at least one supercritical paraffinic solvent recovery step is carried out at a temperature higher than the critical temperature of said paraffinic solvent to be recovered.

35. The process of claim 33 wherein said at least one supercritical paraffinic solvent recovery step is carried out at a temperature from about 20° C. to about 50° C. above said paraffinic solvent critical temperature.

36. The process of claim 33 wherein said at least one supercritical paraffinic solvent recovery step is carried out at a pressure higher than the critical pressure of said paraffinic solvent to be recovered.

37. The process of claim 33 wherein said at least one supercritical paraffinic solvent recovery step is carried out at a pressure from about 10% to about 20% higher than said paraffinic solvent critical pressure.

38. A process for upgrading oil comprising:

optionally pre-treating a heavy oil, wherein said heavy oil further comprises at least one dissolved gas, asphaltenes, water, and mineral solids, reducing at least one dissolved gas content from said heavy oil, optionally further reducing water content from said heavy oil;

adding a paraffinic solvent to said heavy oil, at a predetermined paraffinic solvent:heavy oil ratio, to facilitate separation of asphaltenes, water, and mineral solids from the heavy oil, wherein separation products comprise:

a de-asphalted or partially de-asphalted oil ("DAO")-paraffinic solvent stream, comprising a low asphaltenes content DAO-paraffinic solvent stream; and an asphaltenes-mineral solids-paraffinic solvent-water slurry stream;

optionally separating the paraffinic solvent and water from the asphaltenes-mineral solids-paraffinic solvent-water slurry stream;

separating the DAO-paraffinic solvent stream by fractionation using at least one fractionating step, resulting in a paraffinic solvent rich stream, at least one distillate hydrocarbon fraction stream, and at least one heavy residue fraction stream;

optionally adding diluent to at least one heavy residue fraction stream resulting in transportable oil; and treating said at least one distillate hydrocarbon fraction, for reduction of olefins and di-olefins, and optionally heteroatom reduction, resulting in at least one treated distillate hydrocarbon fraction stream.

39. The process of claim 38 wherein said at least one distillate hydrocarbon fraction is at least two distillate hydrocarbon fractions, and wherein at least one of said at least two distillate hydrocarbon fractions is untreated during said treating of said at least one distillate hydrocarbon fraction resulting in at least one untreated distillate hydrocarbon fraction stream.

40. The process of claim 38 or 39 further comprising mixing said at least one treated distillate hydrocarbon fraction stream with the uncracked portion of said at least one heavy residue fraction stream forming an upgraded oil; optionally if said at least one distillate hydrocarbon fraction is at least two distillate hydrocarbon fractions and at least one stream is untreated, said at least one untreated distillate hydrocarbon fraction stream is further added to said upgraded oil.

41. The process of claim 38 or 39, wherein said olefins-aromatics alkylation is carried out at a temperature of from about 50° C. to about 350° C.

42. The process of claim 38 or 39 wherein said olefins-aromatics alkylation is carried out at a temperature of from about 150° C. to about 320° C.

43. The process of claim 38 or 39 wherein said olefins-aromatics alkylation is carried out at a pressure of from about atmospheric pressure to about 8000 kPa.

44. The process of claim 38 or 39 wherein said olefins-aromatics alkylation is carried out at a pressure of from about 2000 kPa to about 5000 kPa.

45. The process of claim 38 or 39 wherein said olefins-aromatics alkylation is carried out at a pressure of from about 10% higher than vapour pressure of the distillate hydrocarbon fraction to be treated.

46. The process of claim 38 or 39 wherein said olefins-aromatics alkylation is carried out at a weight hourly space velocity of from about 0.1 $h^{-1}$ to about 20 $h^{-1}$.

47. The process of claim 38 or 39 wherein said olefins-aromatics alkylation is carried out at a weight hourly space velocity of from about 0.5 $h^{-1}$ to about 2 $h^{-1}$.

48. The process of claim 38 or 39 wherein said olefins-aromatics alkylation further comprises at least one acid catalyst.

49. The process of claim 48 wherein said at least one acid catalyst is a heterogeneous catalyst.

50. The process of claim 49 wherein said heterogeneous catalyst is selected from the group consisting of amorphous silica-alumina, structured silica-alumina molecular sieves, MCM-41, crystalline silica-alumina zeolites, zeolites of the families MWW, BEA, MOR, MFI and FAU, solid phosphoric acid (SPA), aluminophosphase and silico-aluminophosphates, zeolites of the AEL family, heteropolyacids, acidic resins, acidified metals and mixtures thereof.

51. A process for upgrading oil comprising:

optionally pre-treating a heavy oil, wherein said heavy oil further comprises at least one dissolved gas, asphaltenes, water, and mineral solids, reducing at least one dissolved gas content from said heavy oil, optionally further reducing water content from said heavy oil;

adding a paraffinic solvent and water droplets to said heavy oil, at a predetermined paraffinic solvent:heavy oil ratio, to facilitate separation of asphaltenes, water, and mineral solids from the heavy oil, wherein separation products comprise:

a de-asphalted or partially de-asphalted oil ("DAO")-paraffinic solvent stream, comprising a low asphaltenes content DAO-paraffinic solvent stream; and an asphaltenes-mineral solids-paraffinic solvent-water slurry stream;

optionally separating the paraffinic solvent and water from the asphaltenes-mineral solids-paraffinic solvent-water slurry stream;

separating the DAO-paraffinic solvent stream by fractionation using at least one fractionating step, resulting in a paraffinic solvent rich stream, at least one distillate hydrocarbon fraction stream, and at least one heavy residue fraction stream;

optionally adding diluent to at least one heavy residue fraction stream resulting in transportable oil.

52. The process of claim 51 wherein each of said water droplets has an average water droplet diameter in the range of from about 5 to about 500 microns.

53. The process of claim 51 wherein each of said water droplets have an average water droplet diameter in the range of from about 50 to about 150 microns.

54. The process of claim 51 wherein said water droplets are added in an amount of from about 0.5 to about 1.5 vol/vol of C5-Insolubles rejected from the heavy oil.

* * * * *